US010030422B2

(12) United States Patent
Lee

(10) Patent No.: US 10,030,422 B2
(45) Date of Patent: Jul. 24, 2018

(54) DOOR HINGE HEIGHT ADJUSTING DEVICE FOR ROTATING DOOR

(71) Applicant: Filobe Co., Ltd., Daegu (KR)

(72) Inventor: Kwang-Seok Lee, Daegu (KR)

(73) Assignee: FILOBE CO., LTD., Daegu (KR)

( * ) Notice: Subject to any disclaimer, the term of this patent is extended or adjusted under 35 U.S.C. 154(b) by 0 days.

(21) Appl. No.: 15/511,350

(22) PCT Filed: Sep. 15, 2014

(86) PCT No.: PCT/KR2014/008587
§ 371 (c)(1),
(2) Date: Mar. 15, 2017

(87) PCT Pub. No.: WO2016/043355
PCT Pub. Date: Mar. 24, 2016

(65) Prior Publication Data

US 2017/0306671 A1 Oct. 26, 2017

(51) Int. Cl.
*E05D 7/04* (2006.01)
*E05D 11/00* (2006.01)
(Continued)

(52) U.S. Cl.
CPC ..... *E05D 7/04* (2013.01); *E05D 11/00* (2013.01); *E05D 11/06* (2013.01); *E05D 1/00* (2013.01);
(Continued)

(58) Field of Classification Search
CPC ..... Y10T 16/532; Y10T 16/5326; Y10T 16/53257; Y10T 16/5327; Y10T 16/541;
(Continued)

(56) References Cited

U.S. PATENT DOCUMENTS 152,049 A * 6/1874 Roderick ..... 16/364
1,334,442 A * 3/1920 Eanes ..... E05D 15/28 49/396

(Continued)

FOREIGN PATENT DOCUMENTS

FR 2501485 A1 * 9/1982 ..... A47B 77/08
JP 2000-145098 A 5/2000

(Continued)

OTHER PUBLICATIONS

International Searching Authority, International Search Report, PCT/KR2014/006587, dated May 26, 2015 (Korean and English Translation).

(Continued)

*Primary Examiner* — Chuck Mah
(74) *Attorney, Agent, or Firm* — Reichel Stohry LLP; Mark C. Reichel; Natalie J. Dean

(57) ABSTRACT

The present invention relates to a door hinge height adjusting device that can adjust the relative vertical position of a second support bracket with respect to a first support bracket in a door hinge that rotatably connects one side surface of a door forming a rotating door to a support frame in a door frame, the door hinge comprising: the first support bracket which is fixedly connected to the support frame side of a door frame; the second support bracket which is fixedly connected to the door side; and a hinge portion which is provided between the first support bracket and the second support bracket, for relative rotation.

16 Claims, 28 Drawing Sheets

(51) Int. Cl.
*E05D 11/06* (2006.01)
*E05D 1/00* (2006.01)
*E05D 7/00* (2006.01)

(52) U.S. Cl.
CPC ..... *E05D 7/009* (2013.01); *E05D 2007/0469* (2013.01); *E05Y 2900/132* (2013.01)

(58) Field of Classification Search
CPC . E05D 7/04; E05D 7/0407; E05D 2007/0469; E05D 11/00; E05D 11/06; E05D 1/00; E05D 7/009; E05Y 2900/132; E06B 1/70; E06B 7/18; E06B 7/22; E05C 19/04; E05C 17/44; E05C 17/446; E05F 7/06
See application file for complete search history.

(56) References Cited

U.S. PATENT DOCUMENTS 2,062,320 A * 12/1936 Langer ..... E05C 17/44 16/44
2,519,011 A * 8/1950 Aurandt ..... E05C 19/04 16/97
2,627,081 A * 2/1953 Slopa ..... F25D 23/00 16/44
2,696,029 A * 12/1954 Neff ..... E06B 7/20 49/311
3,116,946 A * 1/1964 Deloume ..... E05C 17/443 16/85
3,854,246 A * 12/1974 McAllister ..... E06B 7/2314 49/470
4,073,093 A * 2/1978 Ookawa ..... E06B 5/20 49/303
4,079,550 A * 3/1978 Bursk ..... E06B 1/70 428/344
4,320,598 A * 3/1982 Rodak ..... E06B 7/18 49/480.1
4,726,637 A * 2/1988 Ishizawa ..... E05D 15/26 160/199
4,733,499 A * 3/1988 Guddas ..... E05D 13/04 16/102
6,003,201 A * 12/1999 Ryczek ..... E05D 13/04 16/87 R
6,345,477 B1 * 2/2002 Kepler ..... E06B 1/70 49/468
2002/0035765 A1 * 3/2002 Baer ..... E05D 3/122 16/354
2003/0005644 A1 * 1/2003 Reithmeyer ..... E05D 7/0027 49/467
2004/0083576 A1 * 5/2004 Reppert ..... E05D 7/04 16/243
2006/0283090 A1 * 12/2006 Moody ..... E06B 1/70 49/467
2007/0107161 A1 * 5/2007 Hilger ..... E05F 7/06 16/102
2007/0113377 A1 * 5/2007 Brachert ..... E05D 7/04 16/247
2007/0261201 A1 * 11/2007 Baer ..... E05D 3/122 16/236
2008/0244866 A1 * 10/2008 Stanley ..... E05D 7/0027 16/238
2012/0181912 A1 7/2012 Cui et al.
2016/0208532 A1 * 7/2016 Humble ..... E05D 7/04

FOREIGN PATENT DOCUMENTS

JP 2000257327 A * 9/2000
JP 2001262932 A * 9/2001
JP 03861827 B2 12/2006
KR 20-0136167 Y1 3/1999
KR 10-2003-0049418 A 6/2003
KR 10-1489246 B1 2/2015

OTHER PUBLICATIONS

International Searching Authority, Written Opinion of the International Searching Authority, PCT/KR2014/008587, dated May 26, 2015 (Korean and English Translation).

* cited by examiner

【Fig. 1】
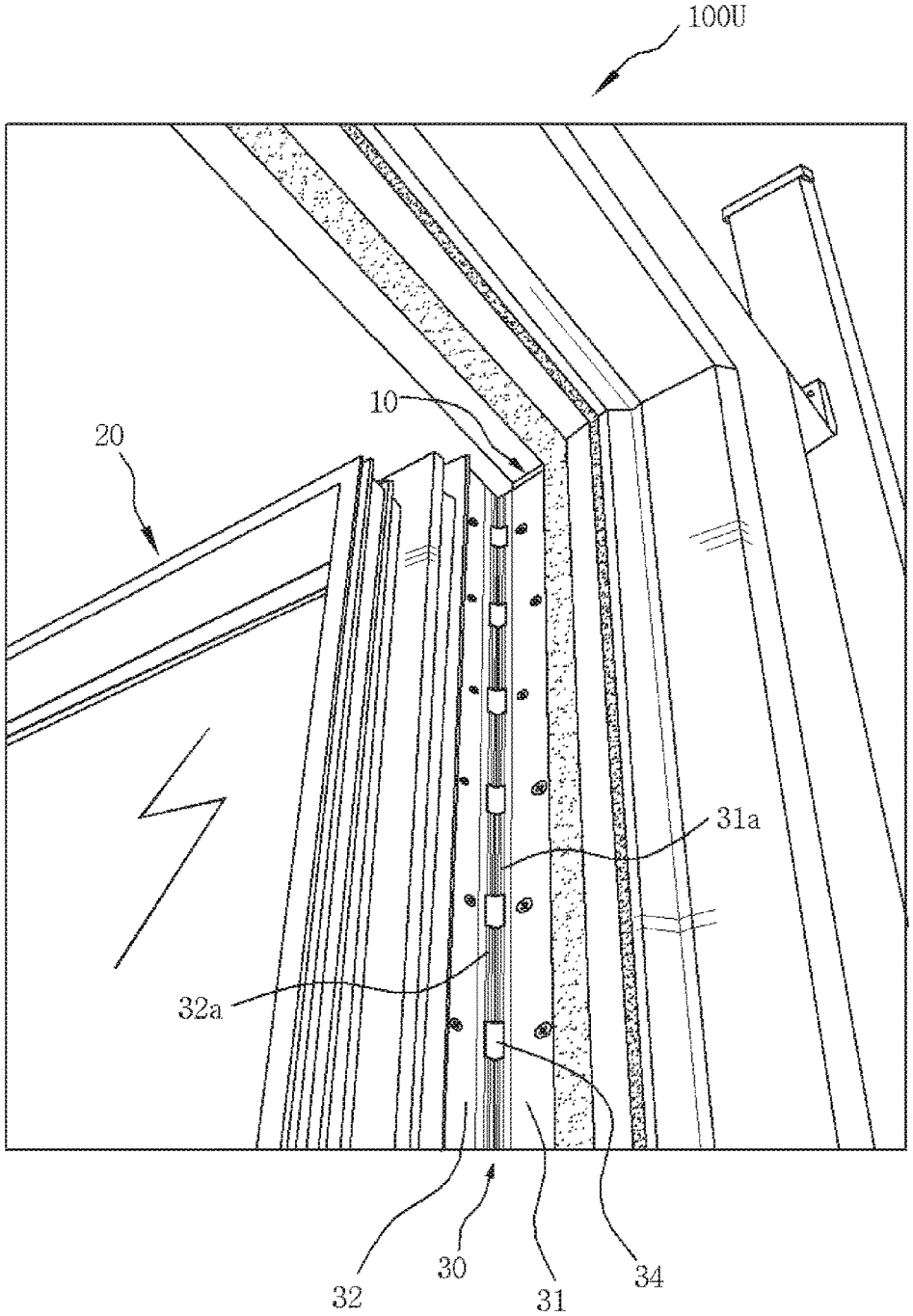

【Fig. 2】
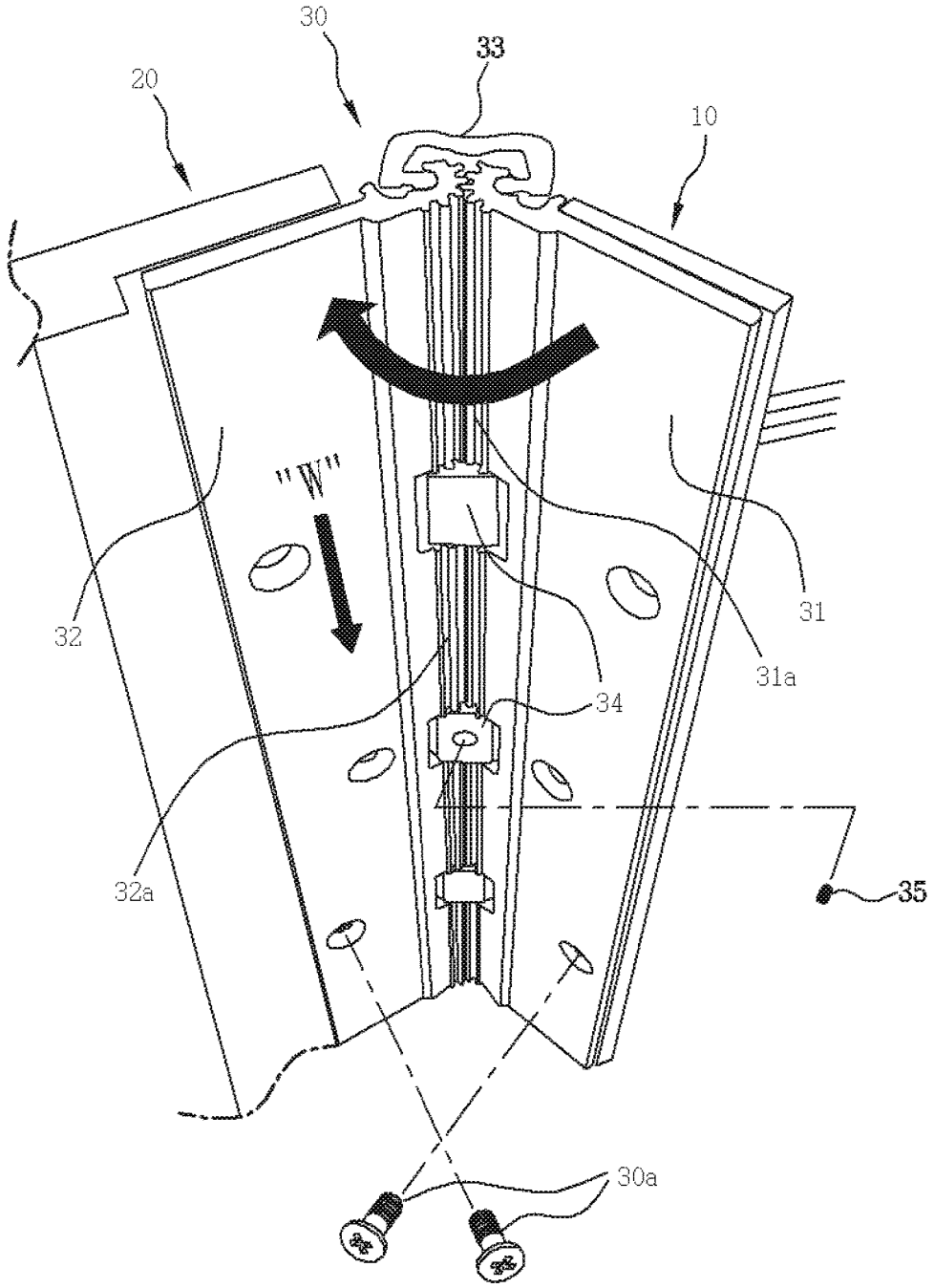

【Fig. 3】
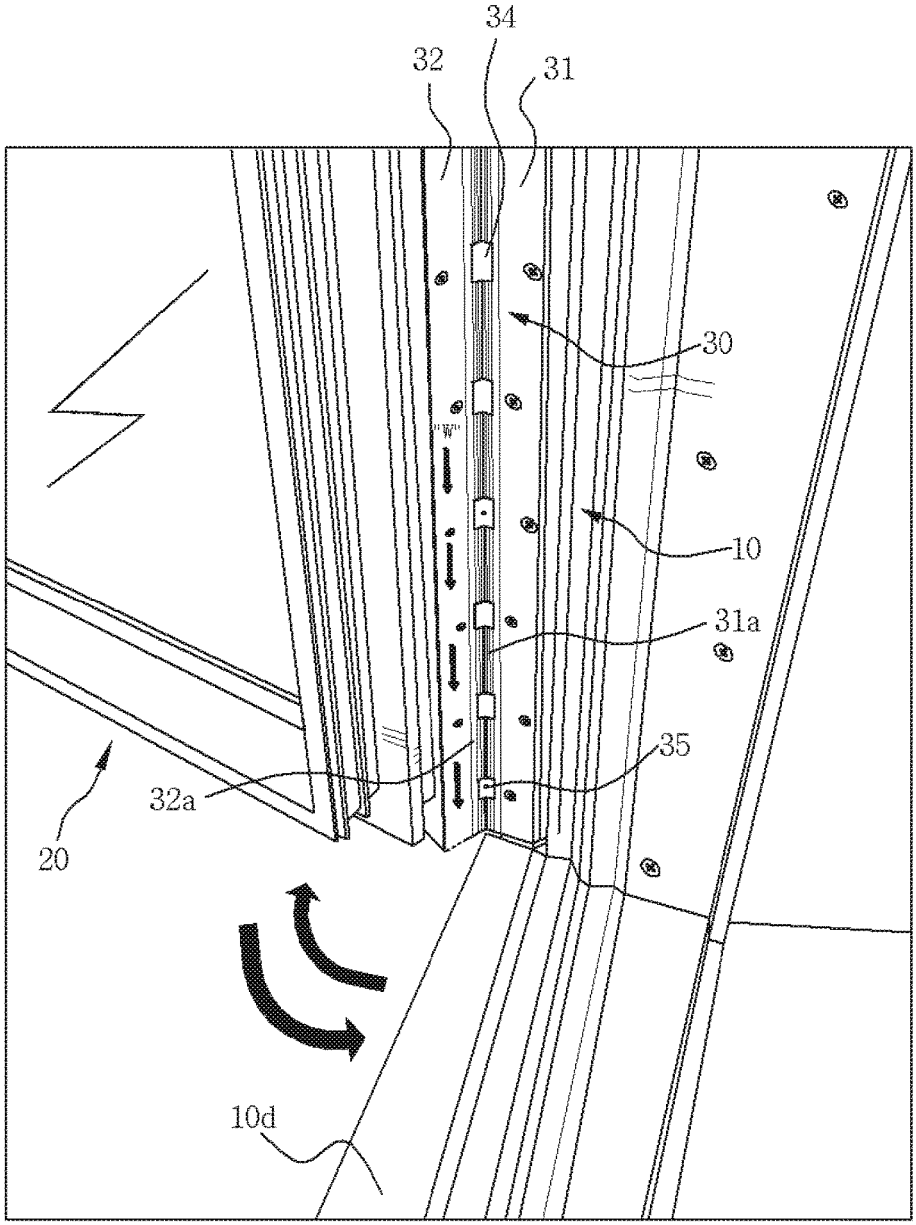

【Fig. 4】
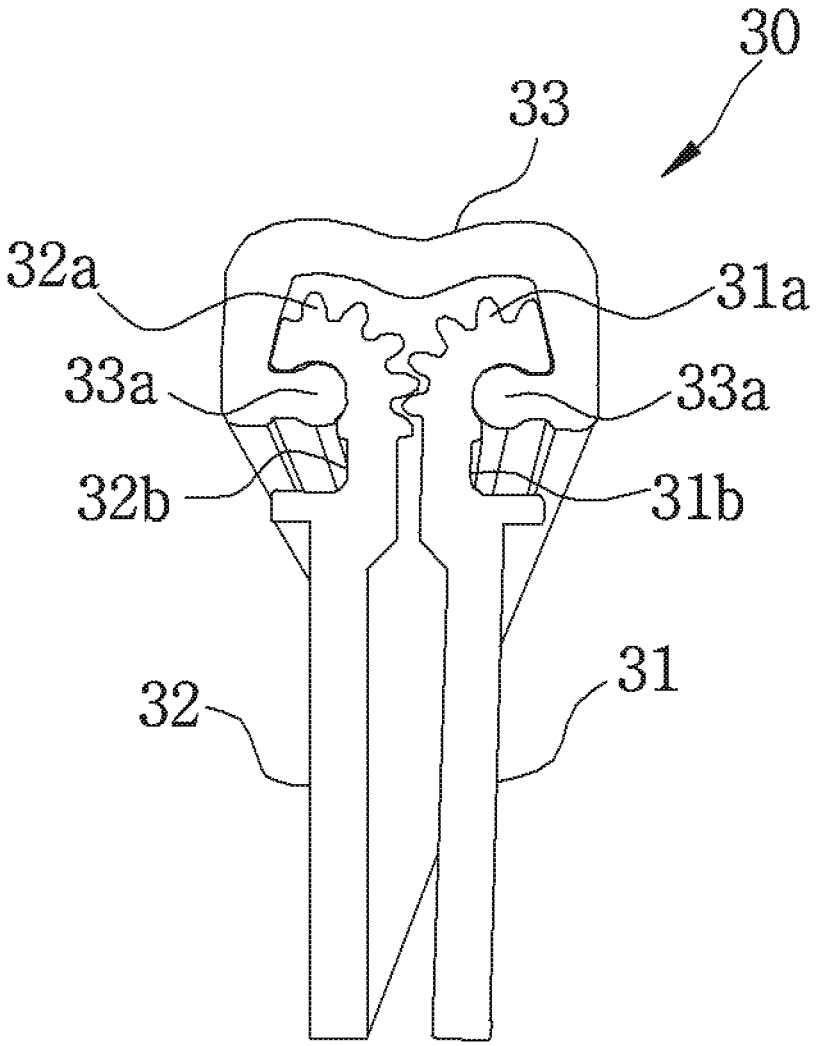

【Fig. 5】
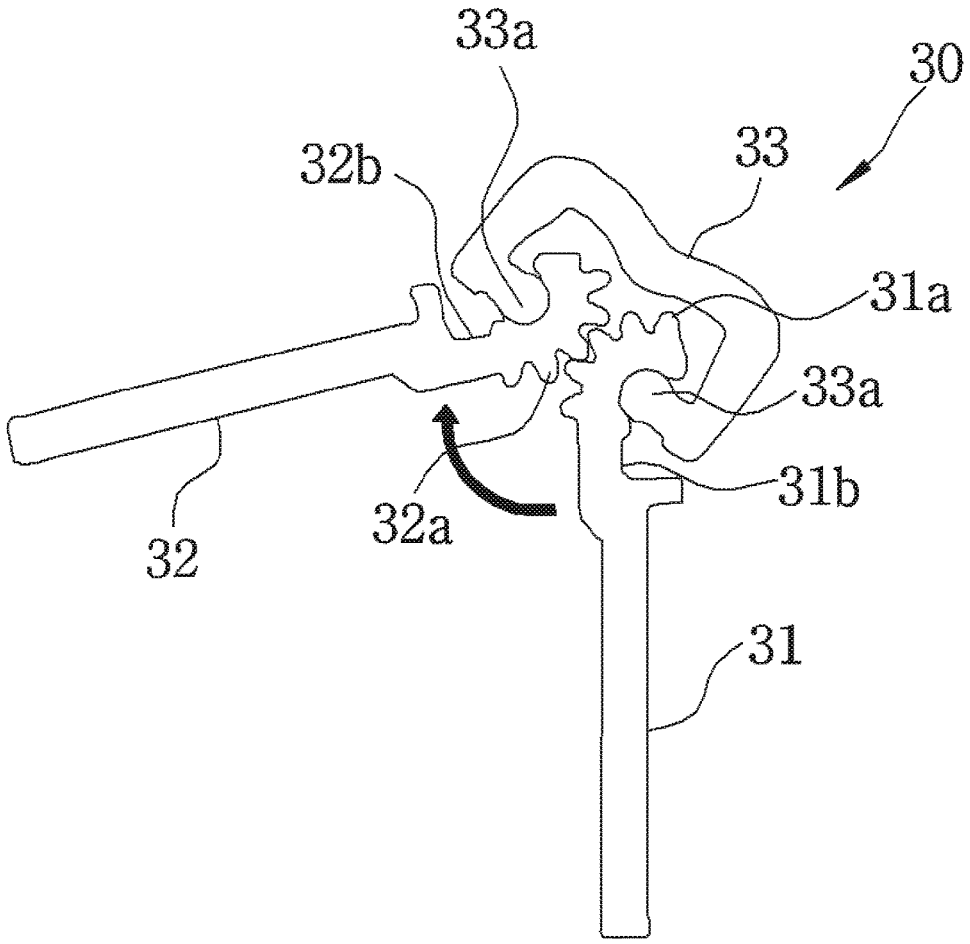

【Fig. 6】
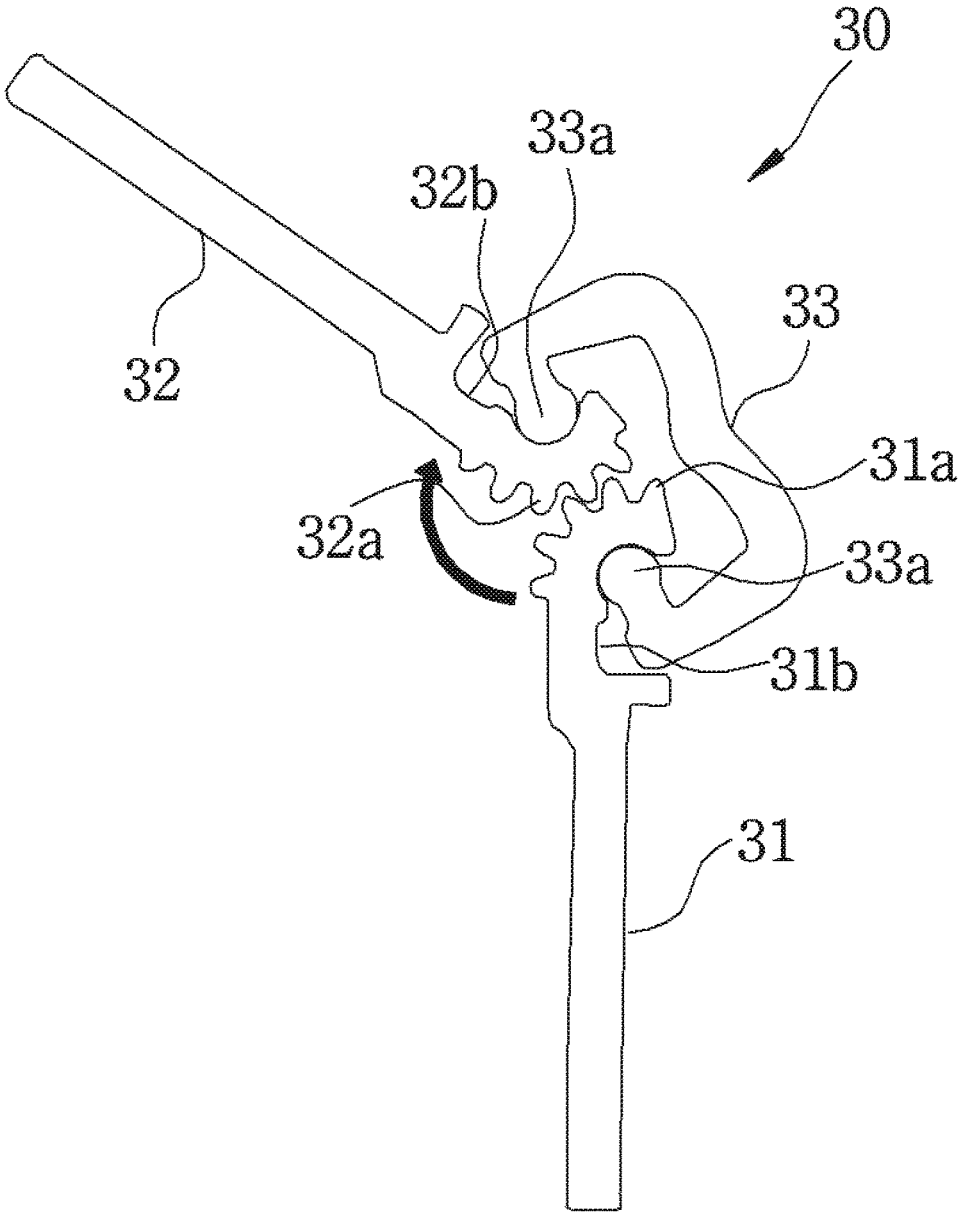

【Fig. 7】
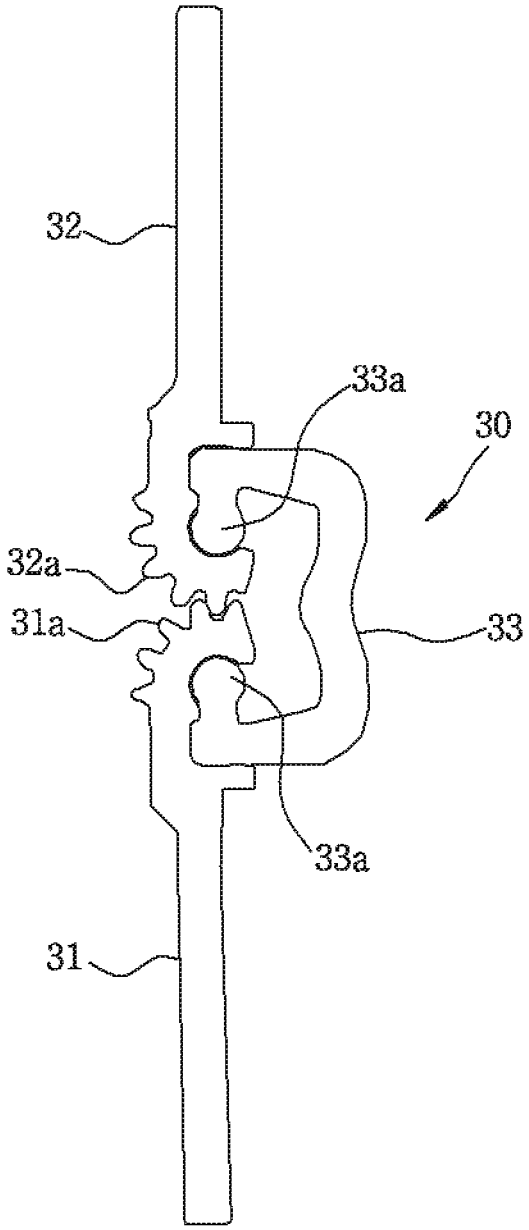

【Fig. 8】
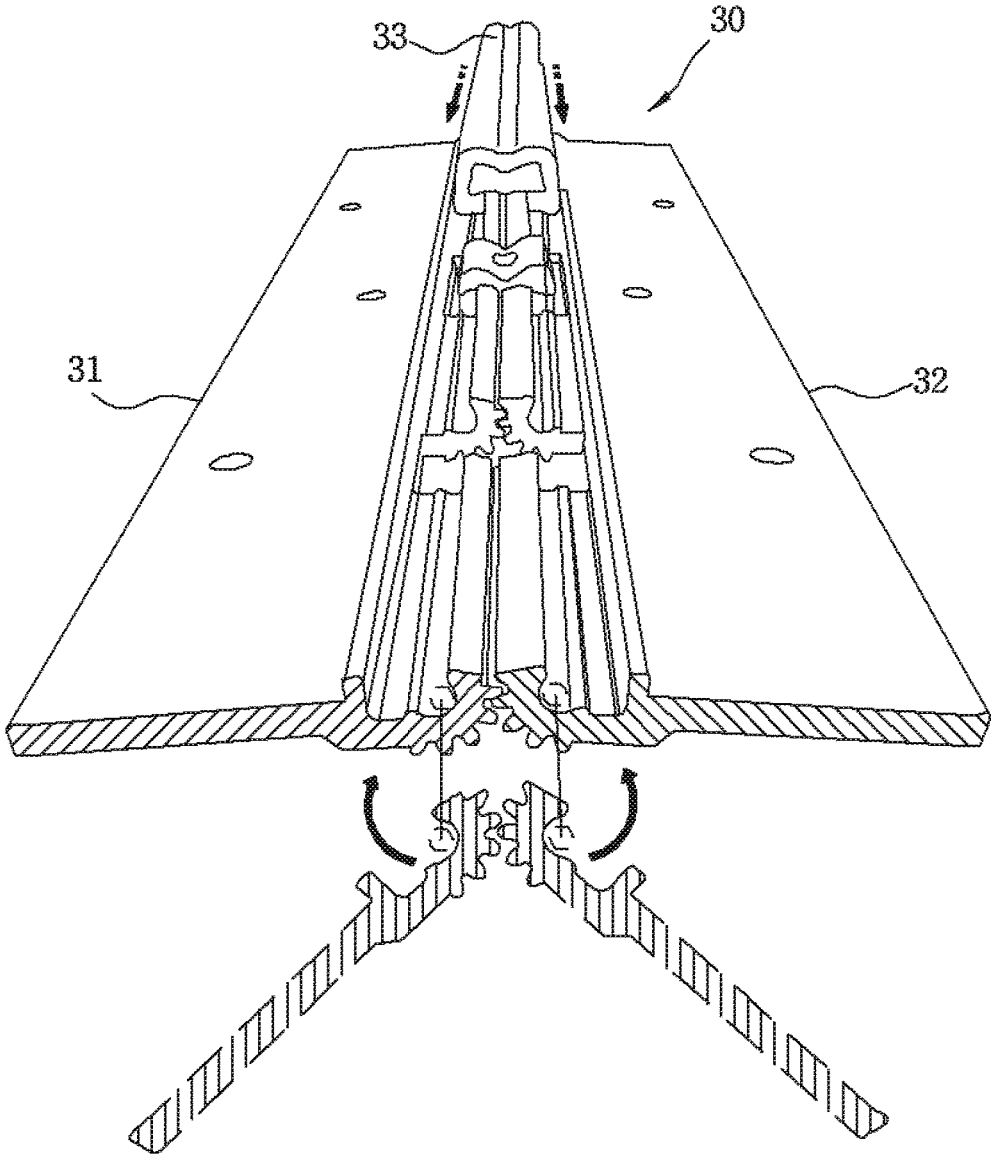

【Fig. 9】
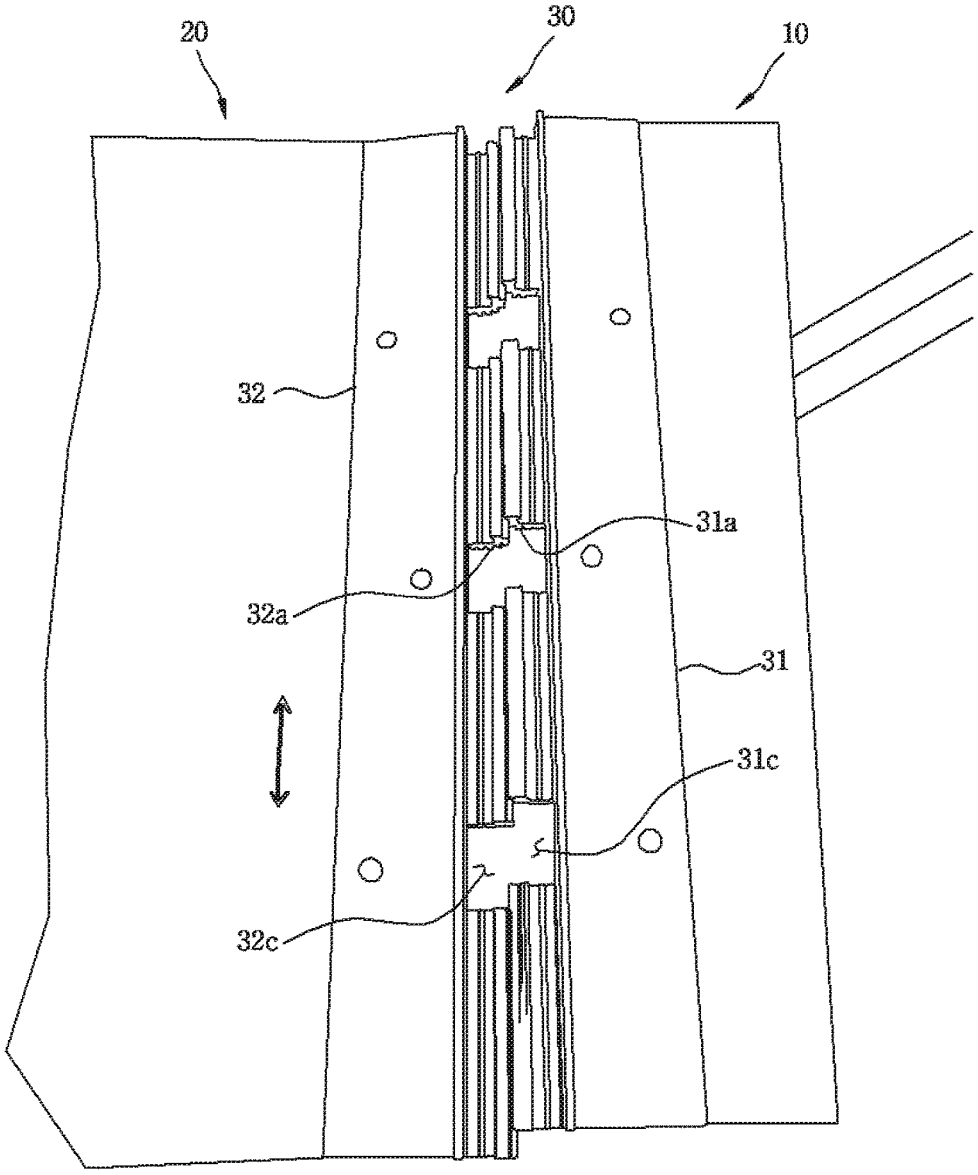

【Fig. 10】
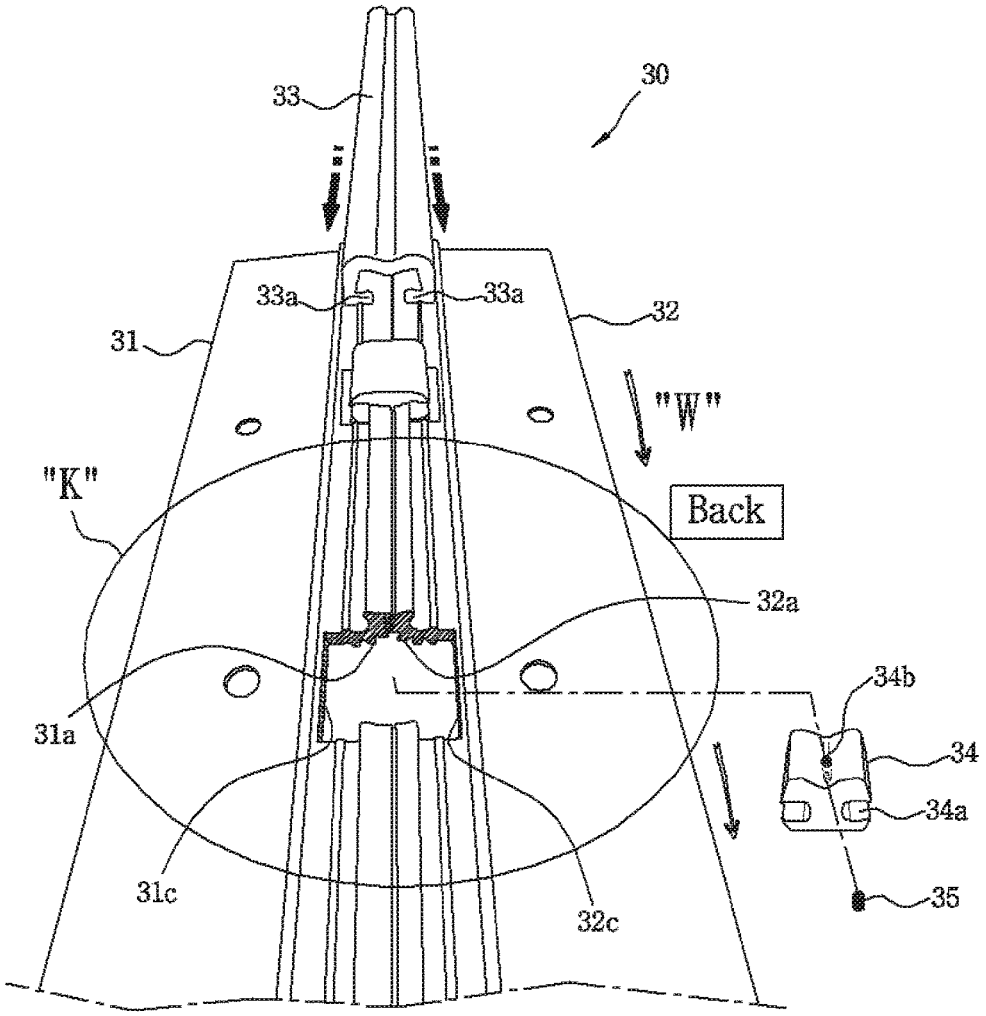

【Fig. 11】
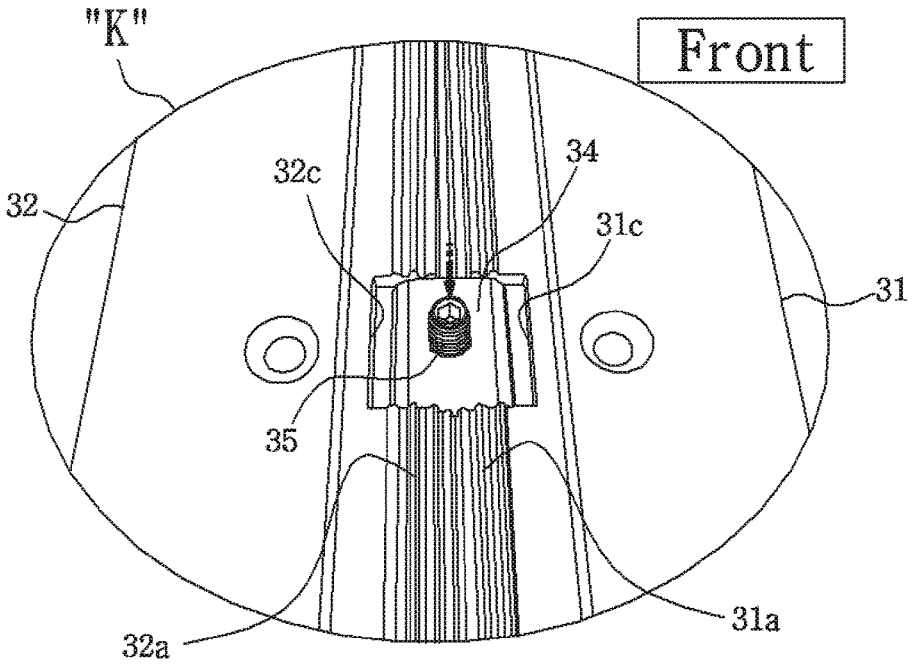

【Fig. 12】
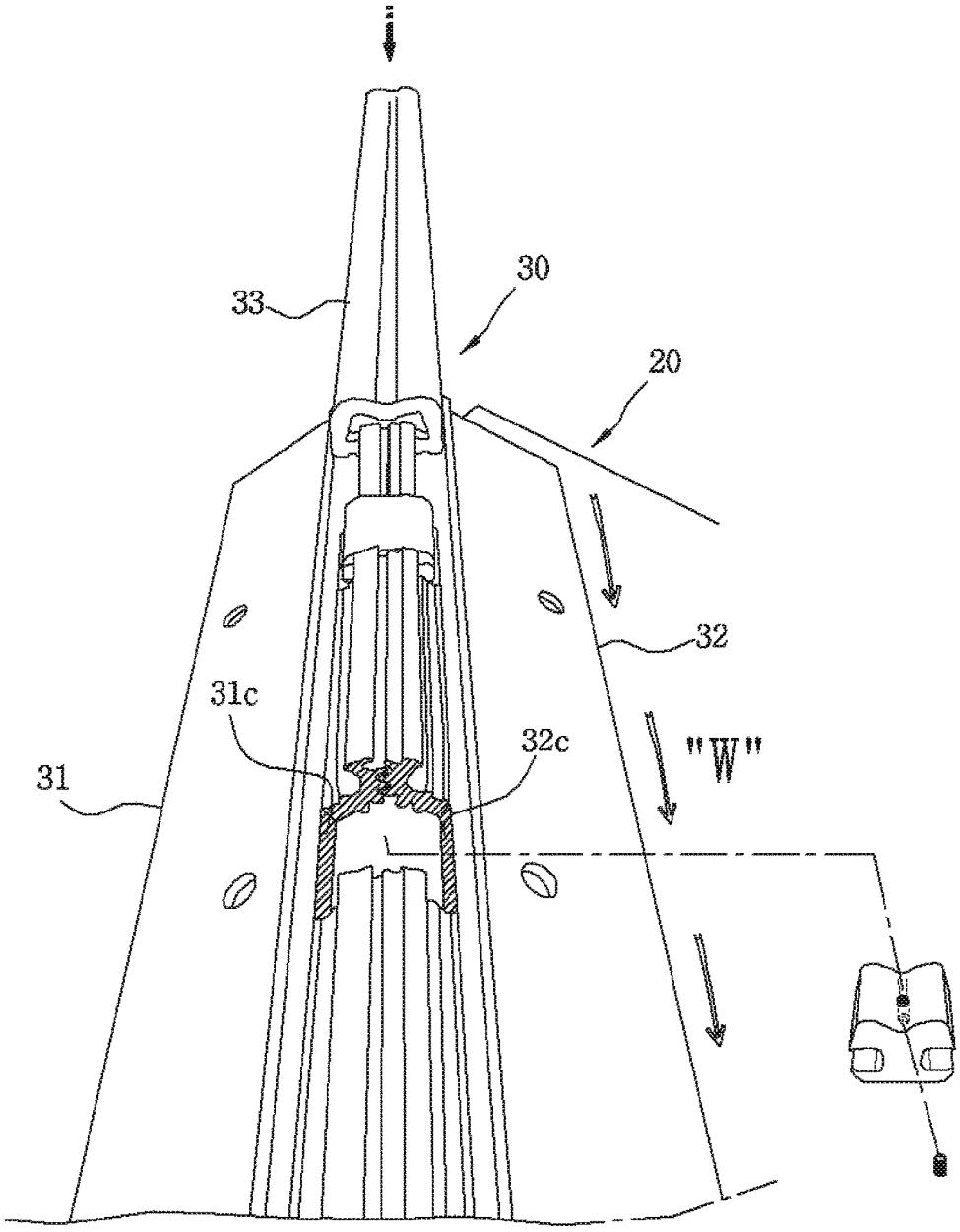

【Fig. 13】
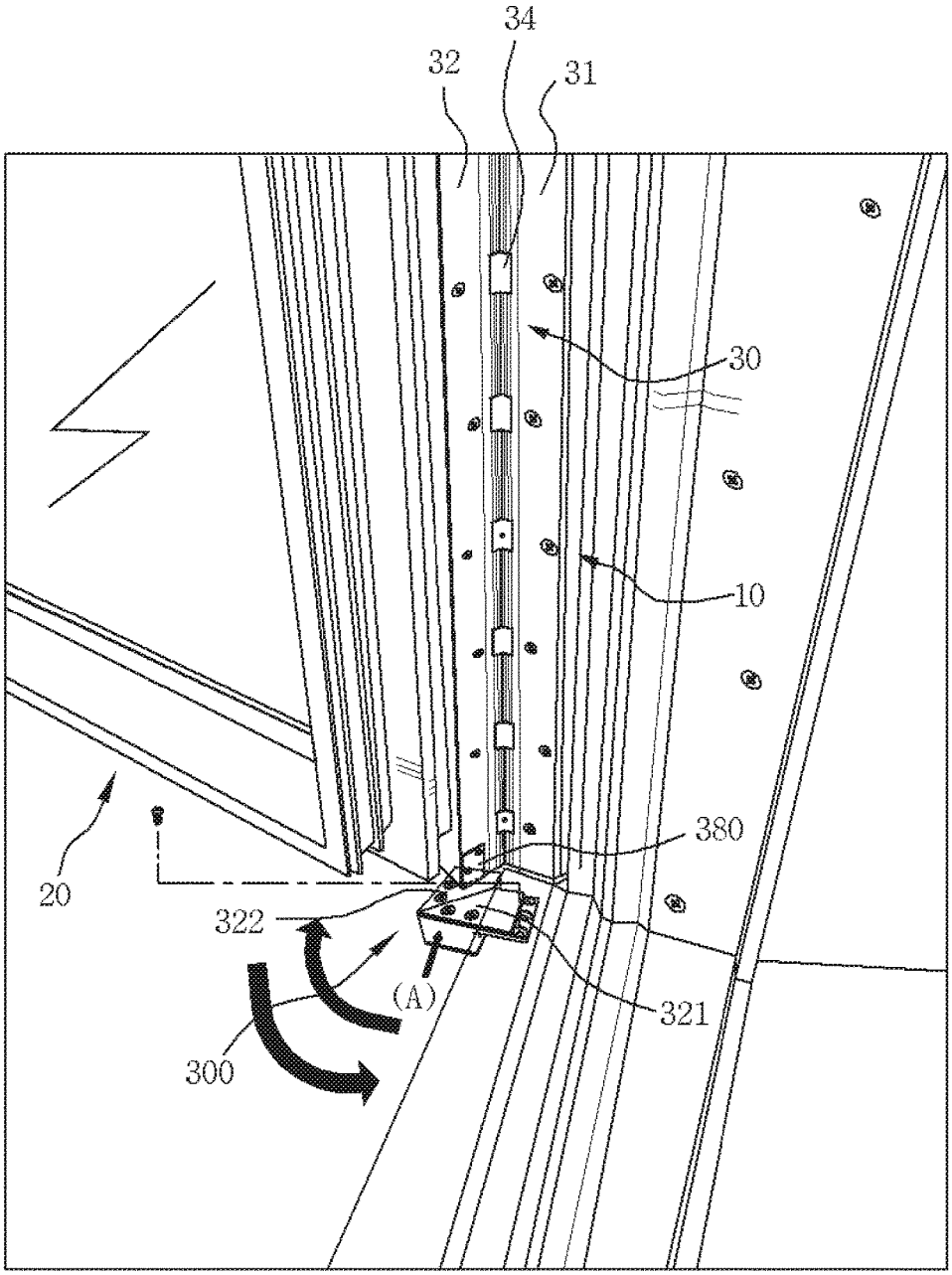

【Fig. 14】
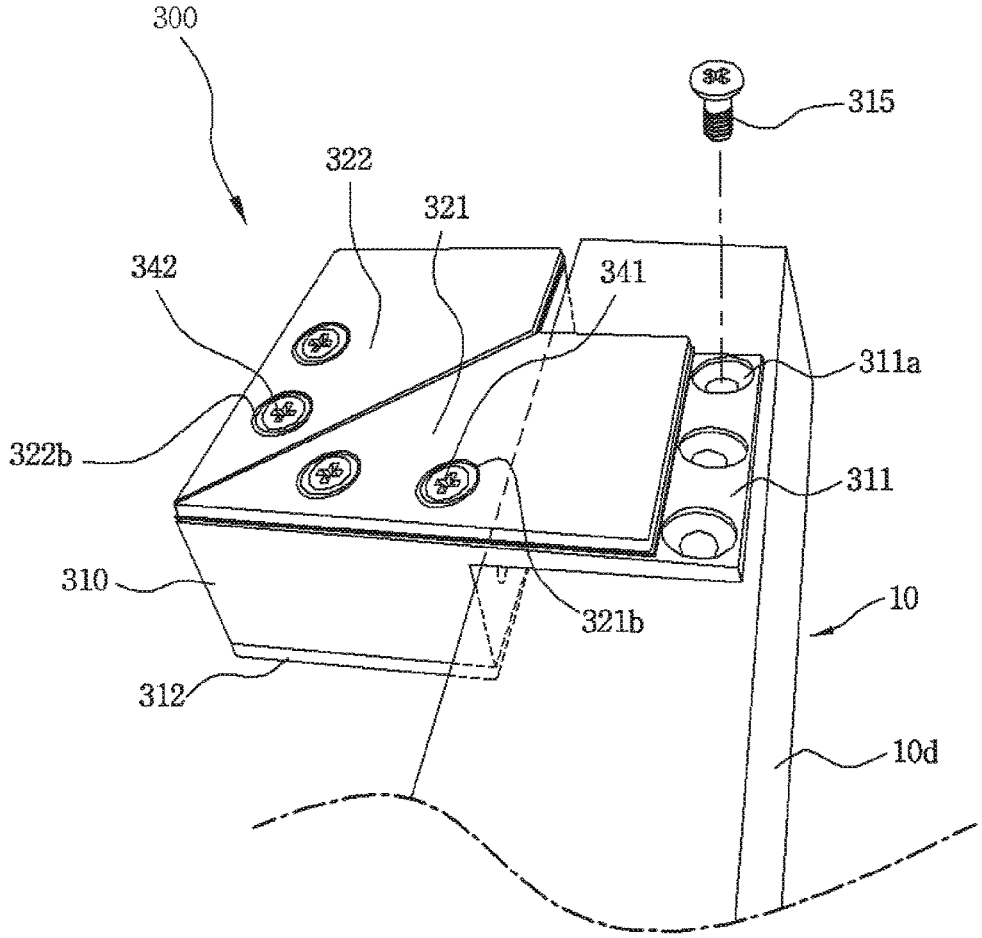

【Fig. 15】
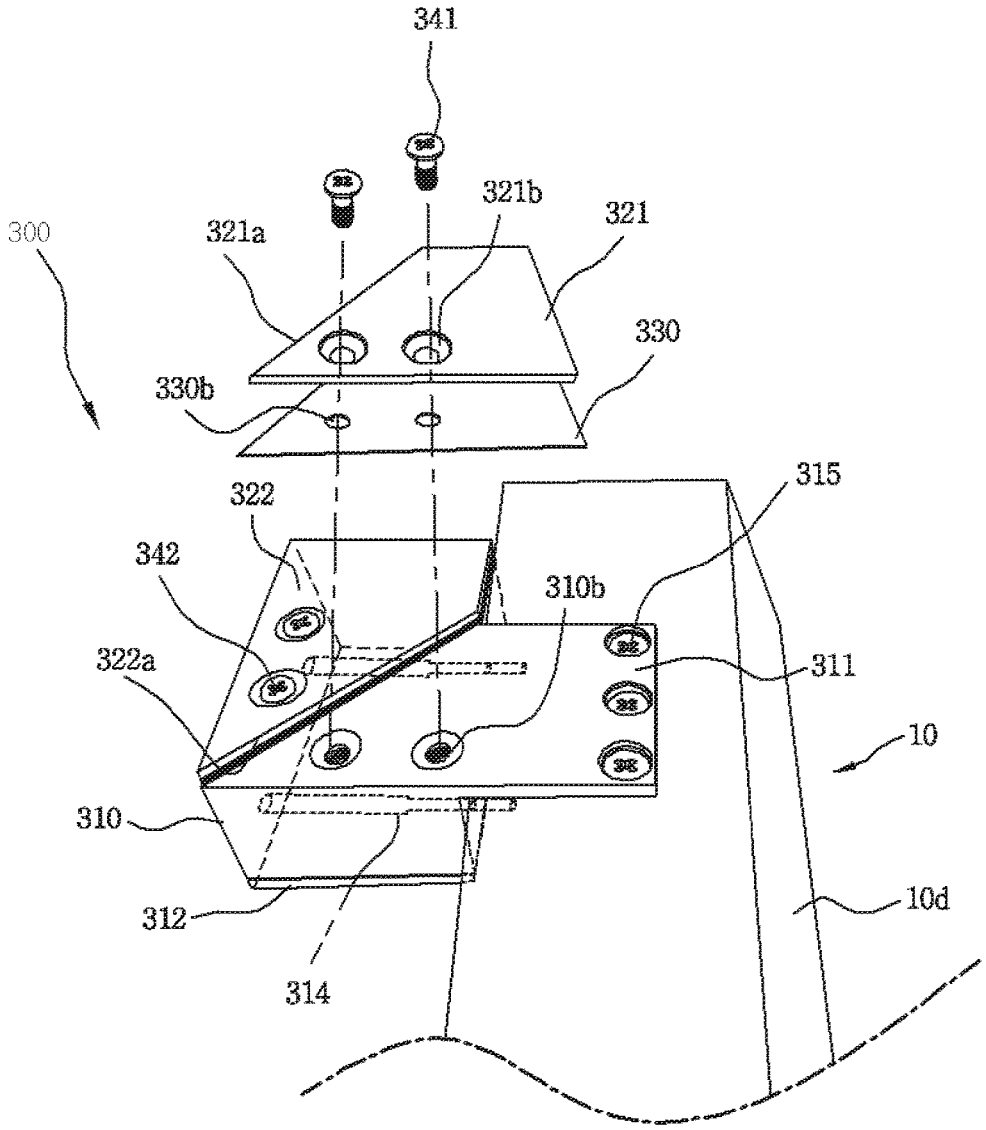

【Fig. 16】
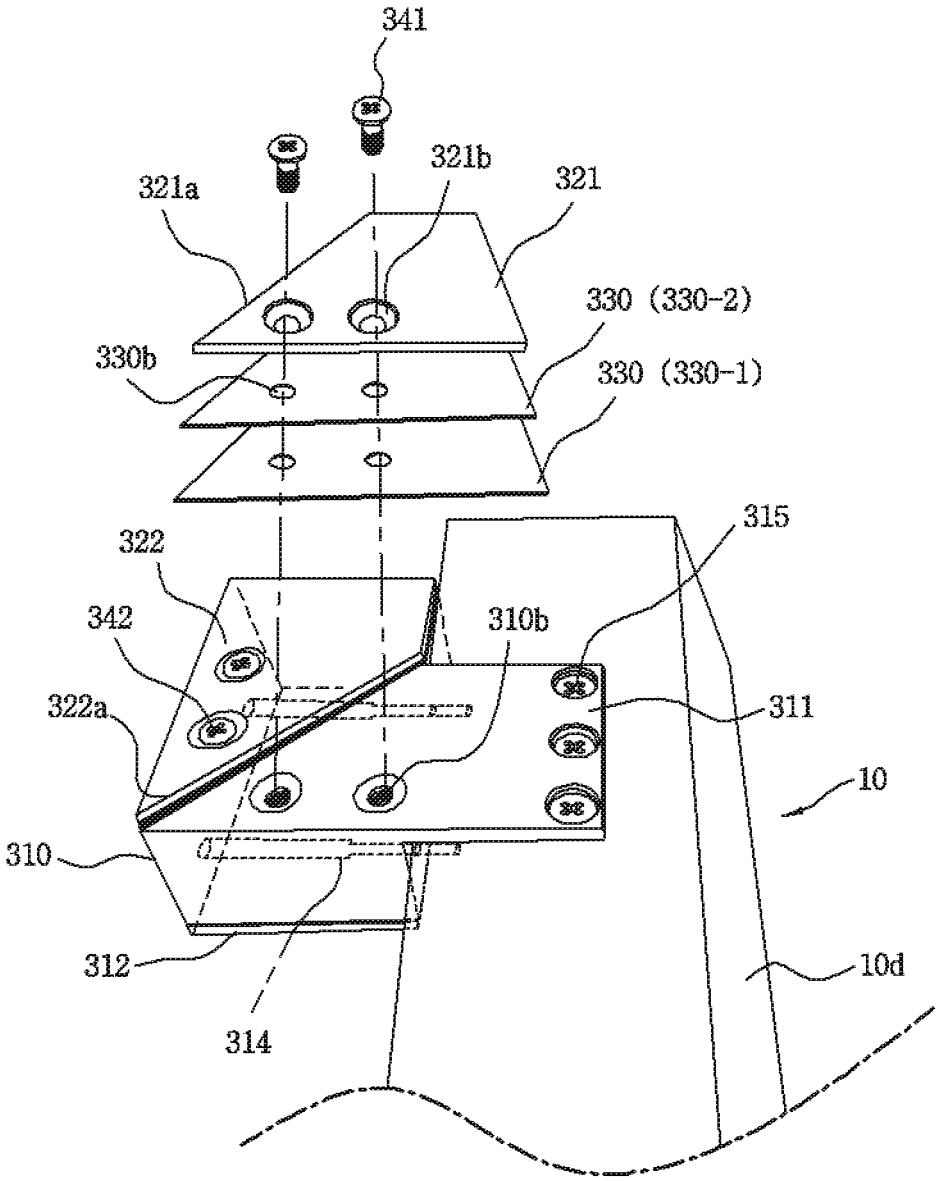

【Fig. 17】
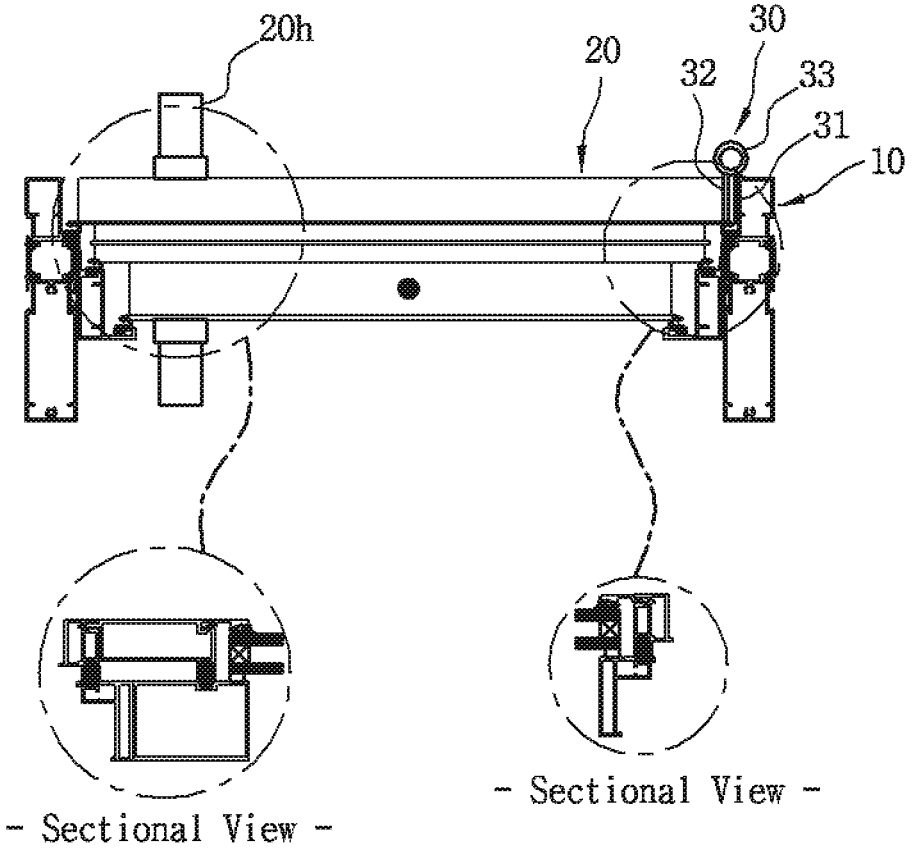

【Fig. 18】
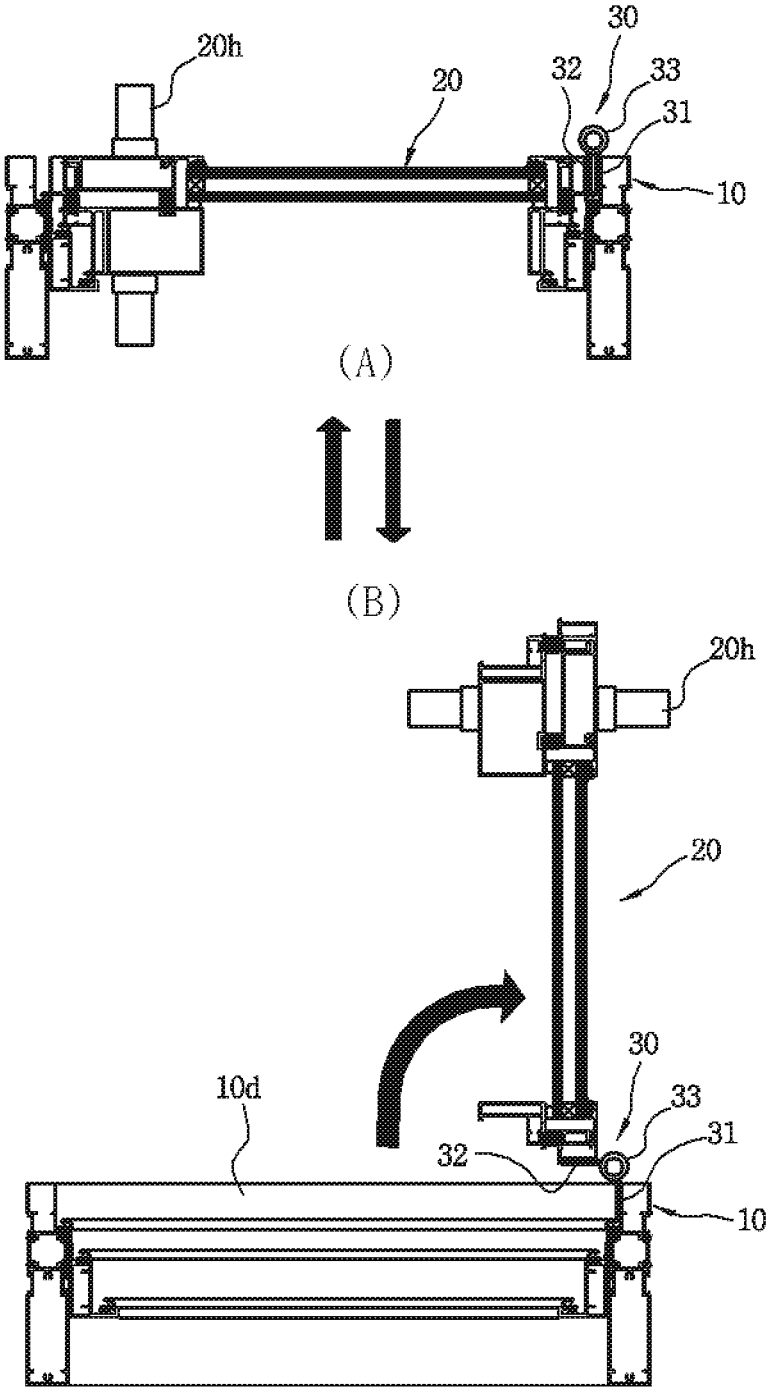

【Fig. 19】
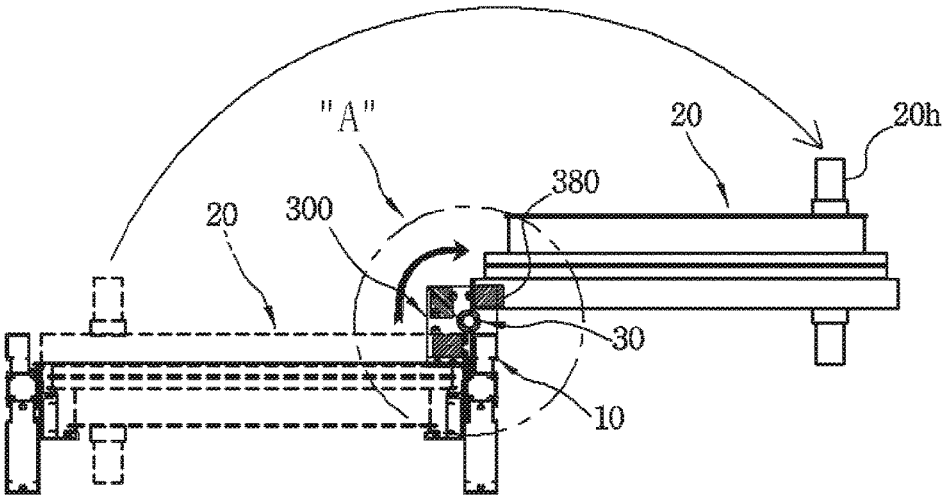

【Fig. 20】
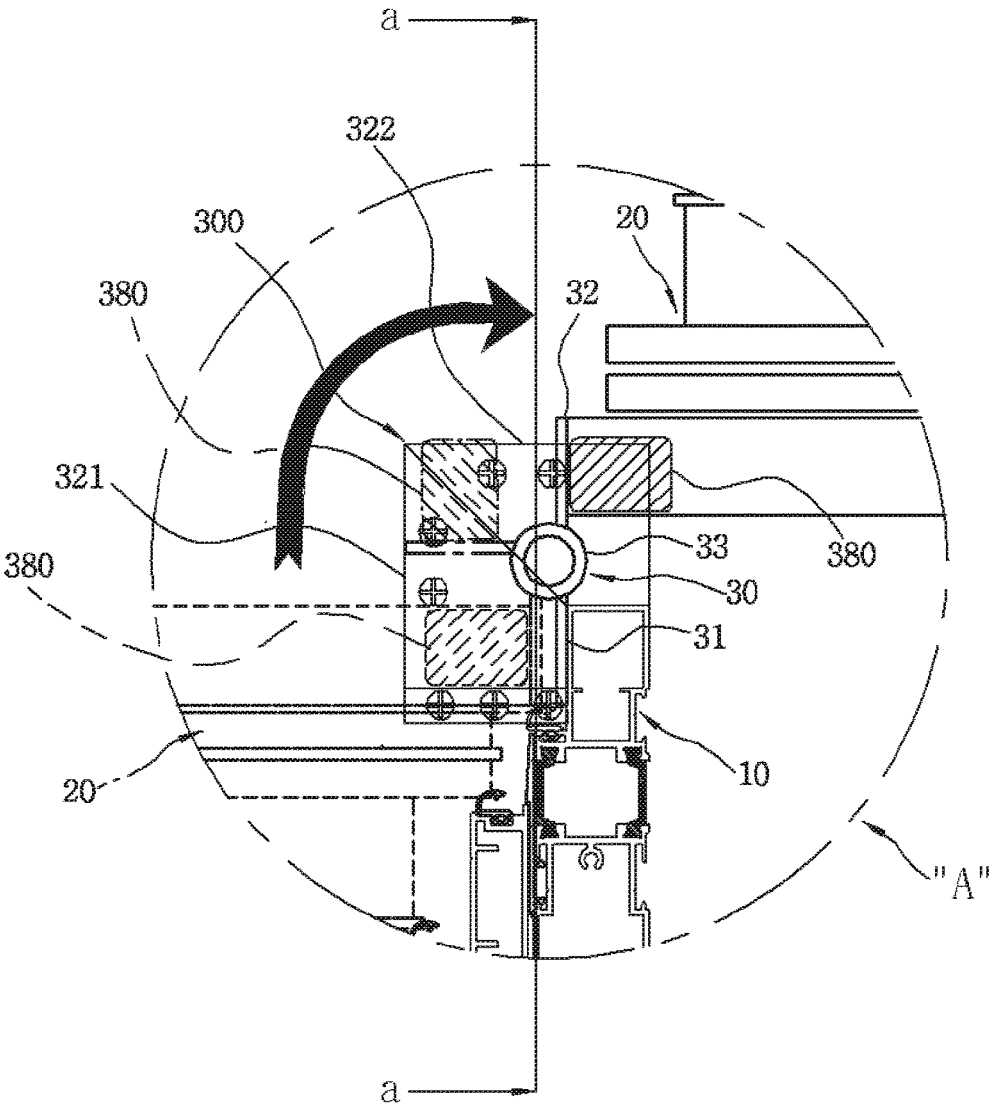

【Fig. 21】
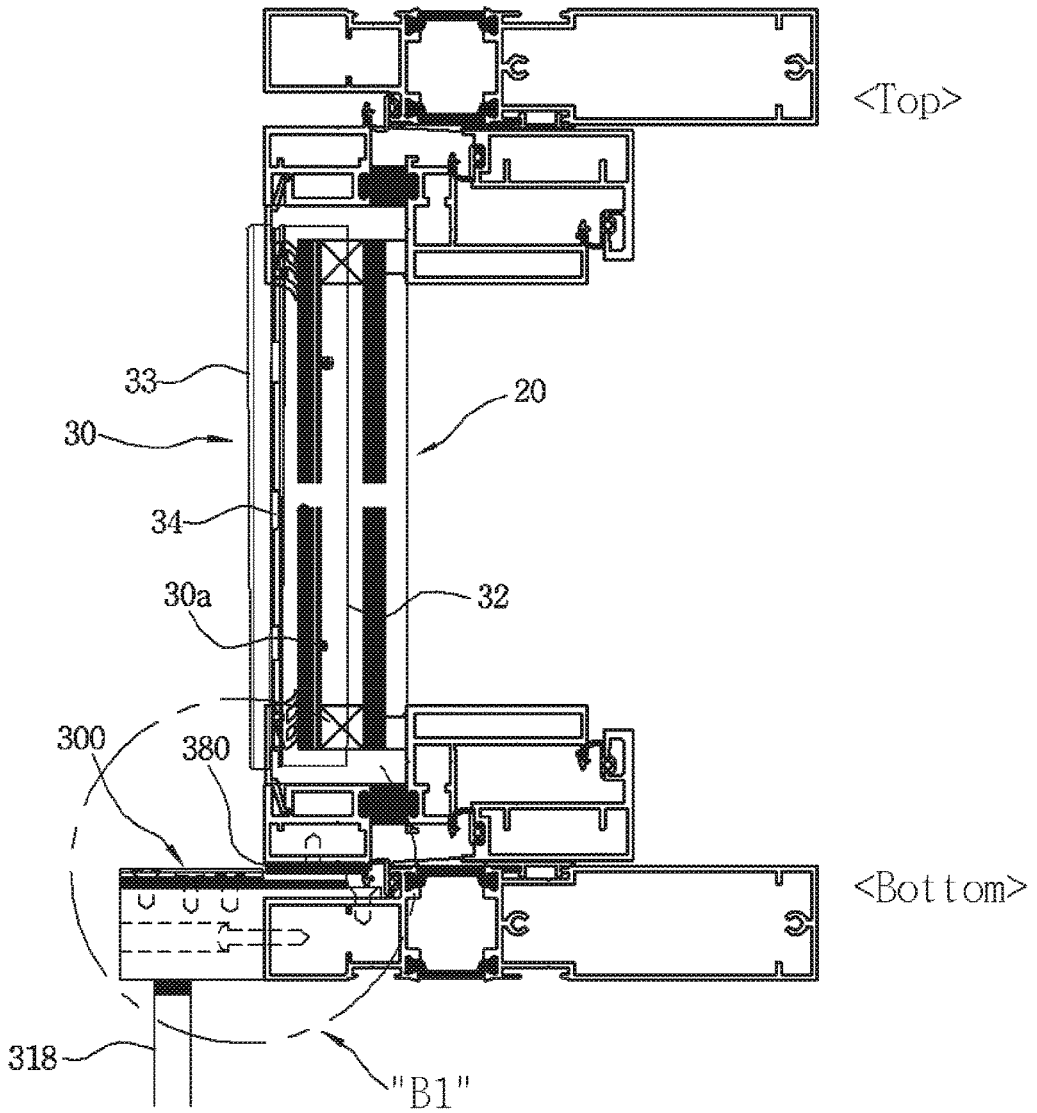

【Fig. 22】
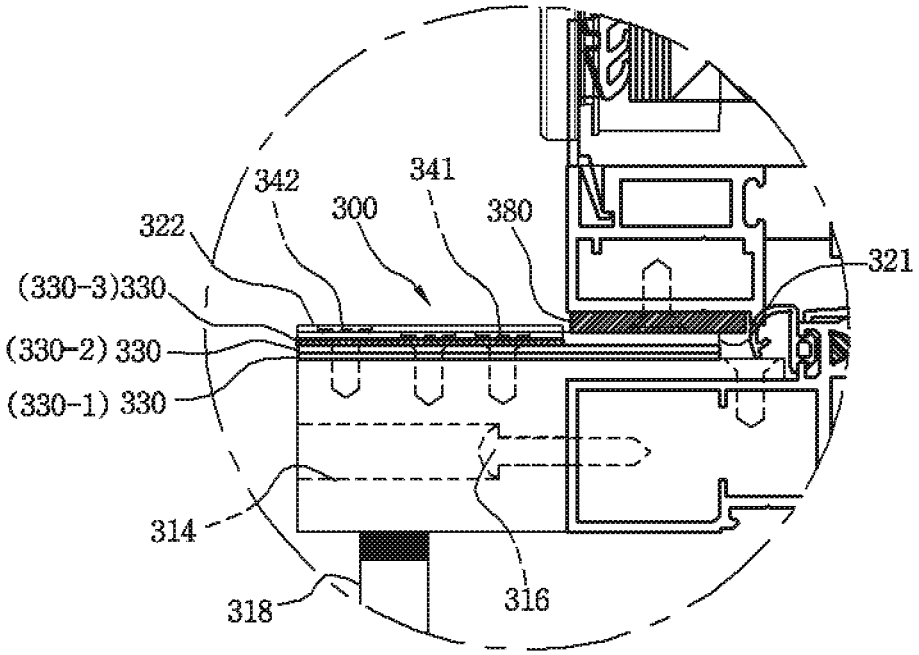
<"B1">

【Fig. 23】
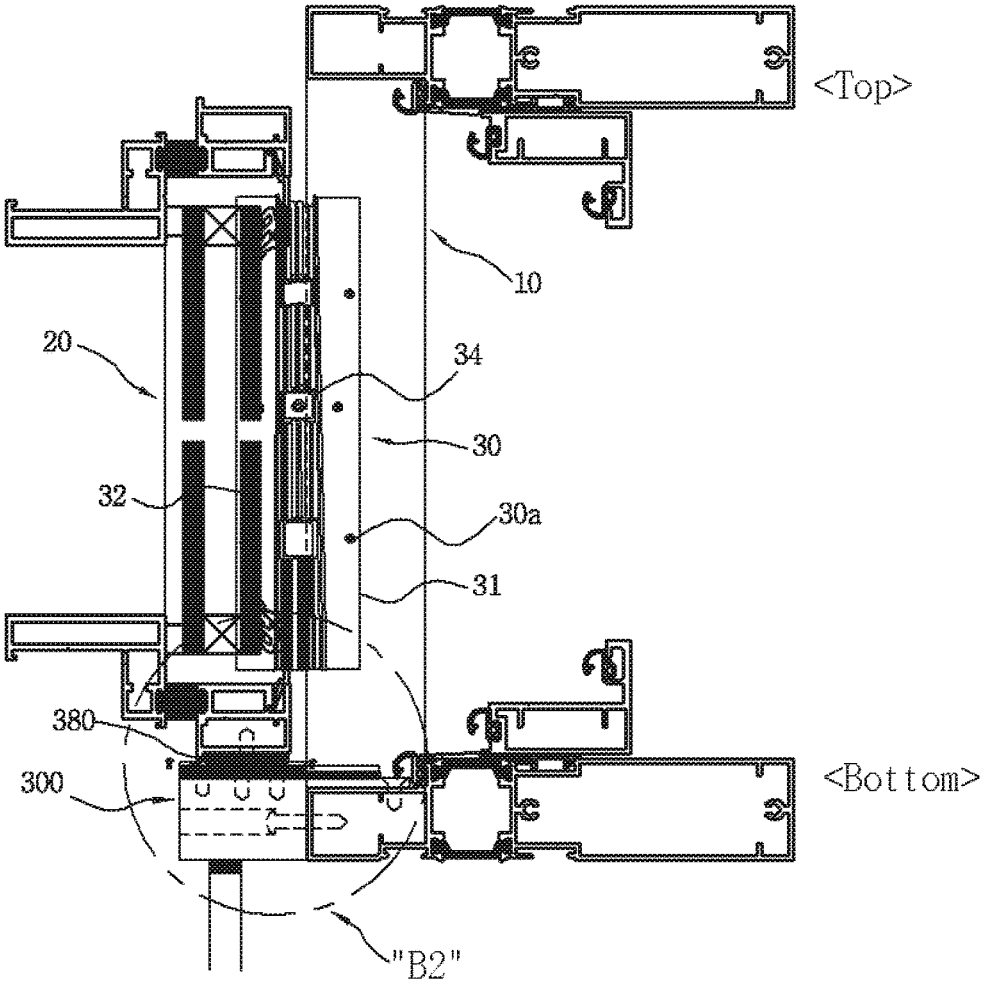

【Fig. 24】
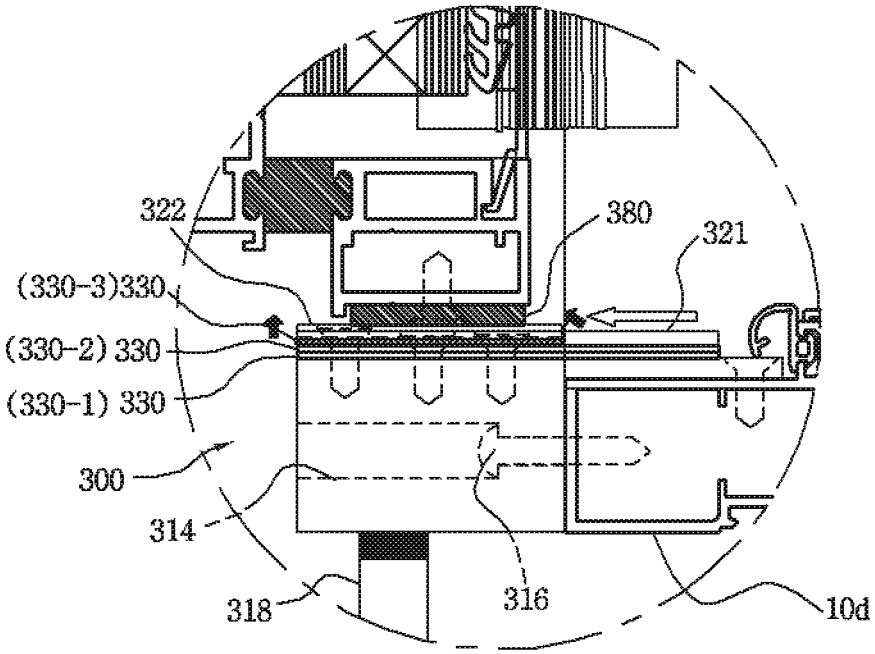
<"B2">

【Fig. 25】
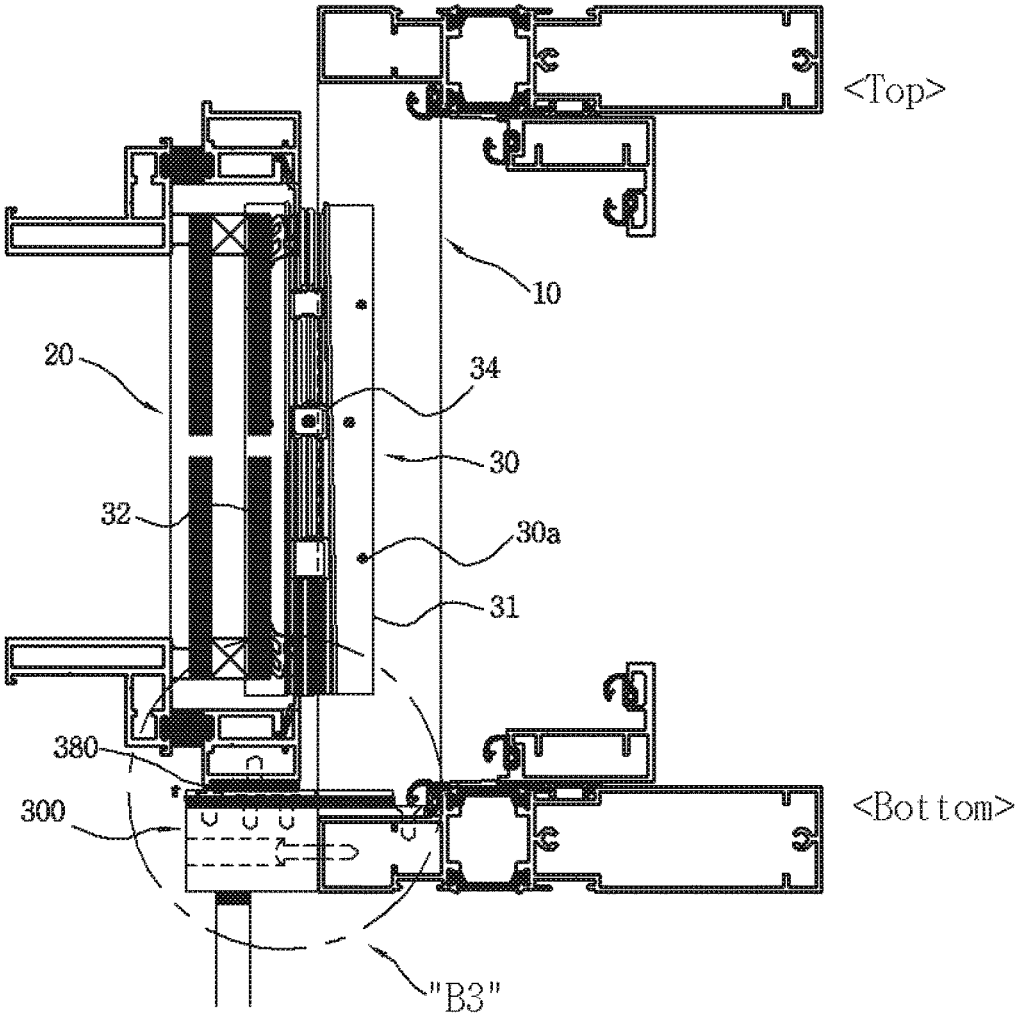

【Fig. 26】
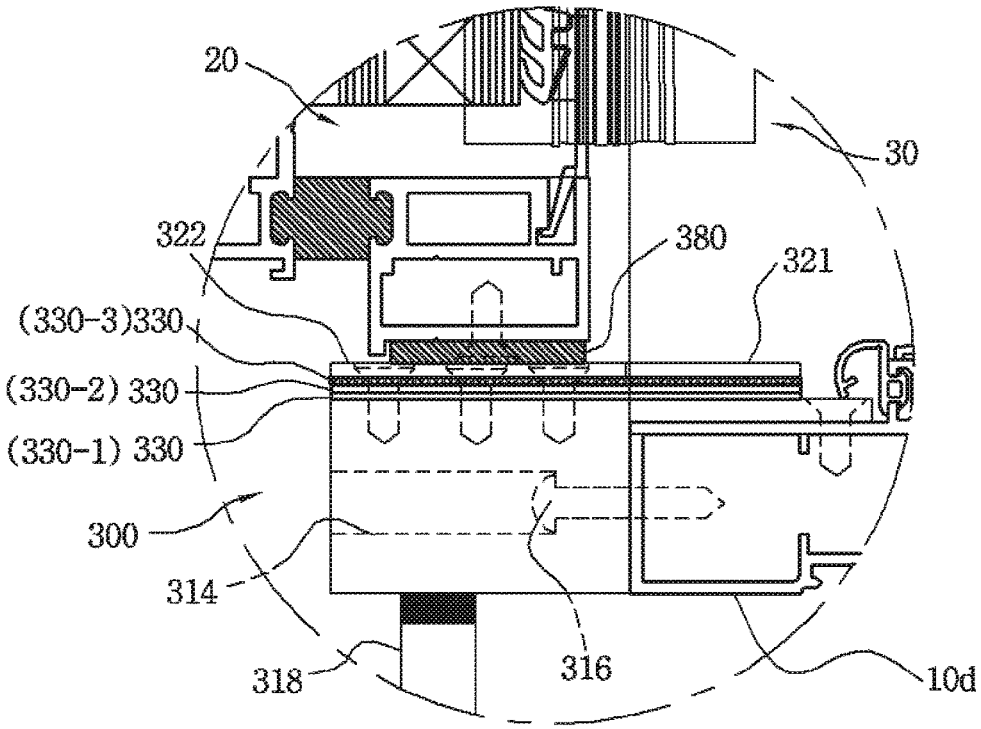
<"B3">

【Fig. 27】
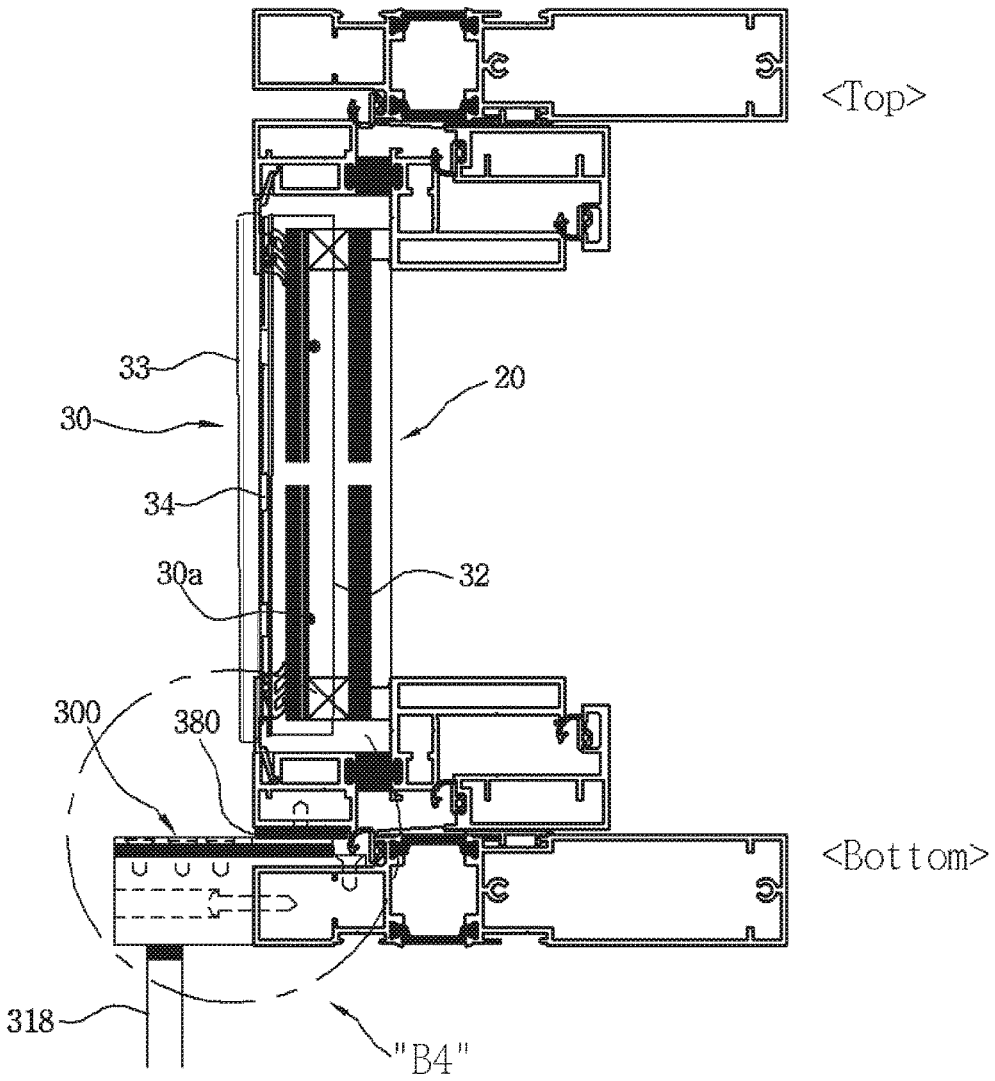

【Fig. 28】
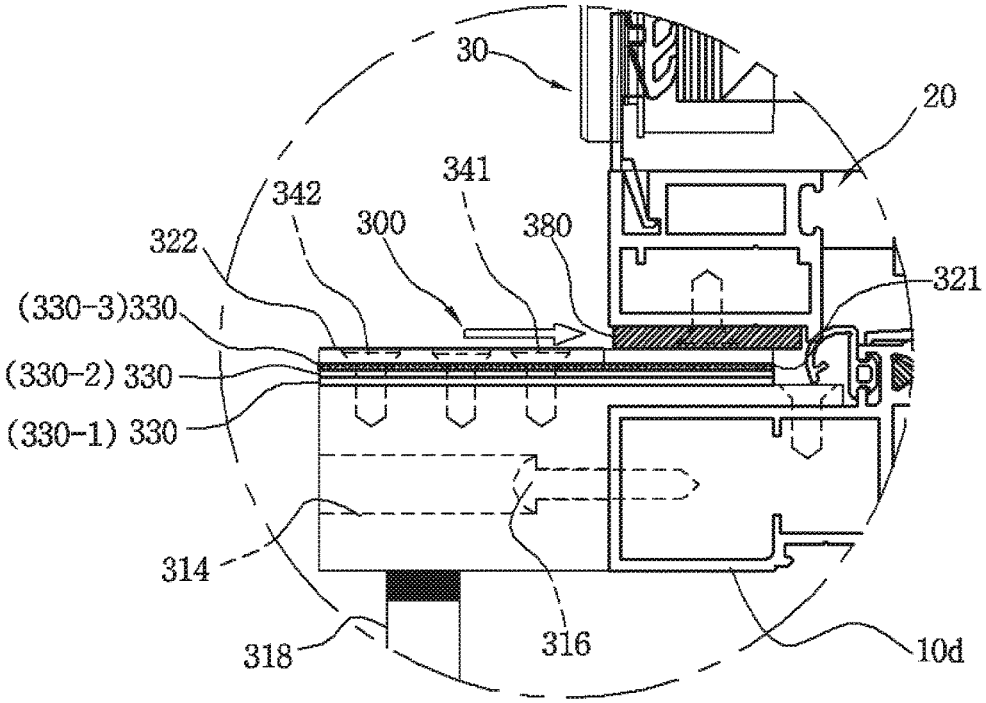
<"B4">

DOOR HINGE HEIGHT ADJUSTING DEVICE FOR ROTATING DOOR

PRIORITY & CROSS-REFERENCE TO RELATED APPLICATIONS

The present application is related to, and claims the priority benefit of, and is a 35 U.S.C. 371 national stage application of, International Patent Application Serial No. PCT/KR2014/008587, filed Sep. 15, 2014, the contents of which are hereby incorporated by reference in their entirety into this disclosure.

TECHNICAL FIELD

The present invention relates to a device which is capable of adjusting a relative vertical position between a first support bracket fixedly connected to a side of a support frame of a door frame and a second support bracket fixedly connected to a side of a door in a door hinge for connecting between a door forming a rotary door and the support frame of the door frame, and more particularly, to a door hinge height adjusting device for rotating a door which allows vertical displacement, which may be generated at a hinge part due to various factors such as a construction error generated when the door is constructed and downward deflection of a second support bracket due to a weight of the door, to be corrected, and is thus capable of ensuring and maintaining an exact opening and closing function of a door and also minimizing generation of friction noise or damage to a component due to friction generated at a door hinge in a door hinge in which a hinge part is provided between a first support bracket and a second support bracket.

BACKGROUND ART

Generally, a rotary door has a structure in which one side surface of the door is fixedly installed inside a support frame of a door frame at which the door is installed, and a door hinge part having a rotating shaft is installed in such a fixing installation surface to allow the door to horizontally rotate, thereby allowing the door to be opened and closed.

Many products having various shapes and structures have been developed and used as such a door hinge part. When a general hinge part using the most widely used pin-type hinge rod is used, a vertical displacement due to a vertical load of a door does not generally occur as long as a hinge frame for supporting the hinge rod is not deformed and a fixing means for fixing the hinge frame to the door or the support frame of the door frame has sufficient strength. However, since strength against a rotational moment on a vertical surface which is generated between an upper end and a lower end of the door is weak, a size and strength of a hinge joint part and a size and strength of a fixing means (an anchor) thereof should also be increased when the door becomes bigger, and thus it is difficult for the door to become bigger. In addition, since a response that satisfies a customer requirement for minimizing and slimming a cross-sectional dimension of the door (or a cross-sectional dimension of the door frame for supporting a window constituting the door) while enlarging a size of the door and a an increase of the size of the fixing means (the anchor) conflict with each other, there is a limit in solving the problem.

A gear hinge part (a gear hinge joint) illustrated in FIGS. 1 to 12 and having a structure different from that of the general hinge part using the pin-type hinge rod has been developed and used as a structure which may minimize the rotational moment generated on the vertical surface of the door between the upper end and the lower end of the door according to a tendency of a door to be large.

Hereinafter, to facilitate an understanding of the present invention, a detailed configuration of the gear hinge part and usage examples of a rotary door using the same will be described first.

In a rotary door 100U illustrated in FIGS. 1 to 3, a first support bracket 31 forming a gear hinge part 30 is fixedly connected to one vertical frame of a door support frame 10 of a door frame by a screw 30*a*, and a second support bracket 32 forming the gear hinge part 30 is fixedly connected to one side surface of a door 20 by the screw 30*a*, and gear parts 31*a* and 32*a* which are formed longitudinally are respectively provided at surfaces of the first support bracket 31 and the second support bracket 32 that face each other to be engaged with each other, and a rotation support frame 33 (referring to FIG. 3) which supports the gear parts 31*a* and 32*a* at a rear side thereof between the first support bracket 31 and the second support bracket 32 is provided so that the first support bracket 31 and the second support bracket 32 are hinge-rotated while the gear parts 31*a* and 32*a*, of the first support bracket 31 and the second support bracket 32 are maintained in an engaged state with each other and gear tooth portions thereof that are engaged with each other are changed.

Meanwhile, the gear hinge part 30 has a planar rotation structure which provides a high resisting force against the rotational moment and a smooth rotational action as illustrated in FIGS. 4 and 7. As illustrated in FIG. 4, hinge shaft protruding portions 33*a* formed to be bent from both ends of the rotation support frame 33 are rotatably inserted into rotating shaft support pockets 31*b* and 32*b* formed at a side that opposes the gear parts 31*a* and 32*a* provided at one end of each of the first support bracket 31 and the second support bracket 32 to be engaged with each other. And as illustrated in FIGS. 5 and 6, the first support bracket 31 and the second support bracket 32 are interlocked with each other to be shaft-rotated about the hinge shaft protruding portions 33*a* formed at both of the ends of the rotation support frame 33. For example, when the first support bracket 31 is fixed to a side of the support frame 10 of the door frame and the second support bracket 32 is fixed to a side of the door 20, the second support bracket 32 is rotated relative to the fixed first support bracket 31, as illustrated in FIGS. 5 to 7.

Furthermore, in a restriction of an axial rotation of the second support bracket 32, as illustrated in FIG. 7, when outer corners of the bent portions formed at both of the ends of the rotation support frame 33 are accommodated in the rotating shaft support pockets 31*b* and 32*b* that are formed at outer side surfaces of the first support bracket 31 and the second support bracket 32, which are rotated outward, excessive rotation thereof is no longer allowed.

The structure in FIGS. 4 to 7 is an example in which the second support bracket 32 can be rotated by about 180 degrees with respect to the first support bracket 31.

As illustrated in FIG. 8, the gear parts 31*a* and 32*a* which are longitudinally formed at both sides of the first support bracket 31 and the second support bracket 32 to be rotated and folded, and the rotation support frame 33, which supports the rotation of the gear parts 31*a* and 32*a* while the gear parts 31*a* and 32*a* are engaged with each other, allow smooth rotation between the first support bracket 31 and the second support bracket 32 on a horizontal plane and also provide a structure in which gear teeth, which are longitudinally formed to be long, are engaged with each other. Accordingly, even when the rotational moment generated on the vertical surface of the door between the upper end and the lower end of the door is increased due to a large size of the door 20, it is possible to sufficiently respond to the increased rotational moment, thereby providing structural stability which may minimize the possibility of a distortion phenomenon in an installation direction or position of the door.

Meanwhile, as illustrated in FIG. 9, the first support bracket 31 and the second support bracket 32, which are rotated while being engaged with each other by the gear parts 31*a* and 32*a* longitudinally formed at both sides thereof, may have a cross-sectional structure in which the second support bracket 32 that is fixedly connected to the side of the door 20 may be longitudinally displaced with respect to the first support bracket 31 that is fixedly connected to the side of the support frame 10 of the door frame. Therefore, to prevent this, openings 31*c* and 32*c* are respectively formed at the first support bracket 31 and the second support bracket 32 to face each other as illustrated in FIGS. 10 and 11, and a vertical hooking tool 34 is commonly inserted into the openings 31*c* and 32*c* that face each other and then fixed to an inner surface of the rotation support frame 33 through a fastening hole 35, as illustrated in FIGS. 10 and 11, and one end of the hooking tool 34 is geometrically matched with and accommodated in an inner space of the rotation support frame 33 and thus forms the gear hinge part 30.

An upper surface and a lower surface of the vertical hooking tool 34, which is provided to restrict the longitudinal displacement generated between the first support bracket 31 and the second support bracket 32 and also to support a vertical load, support cross sections of portions of the gear parts 31*a* and 32*a* of the first support bracket 31 and the second support bracket 32 at which the openings 31*c* and 32*c* are formed while being rubbed thereby when the door is rotated to be opened and closed, and thus are formed of a synthetic resin material which has a low friction coefficient and prevents a friction noise, unlike the first support bracket 31 and the second support bracket 32 generally formed of a metal material such as an aluminum alloy material.

However, in an actual situation in which the large-sized door 20 is installed at the support frame 10 of the door frame through the above-mentioned gear hinge part 30, as illustrated in FIG. 12, a downward displacement induced on the second support bracket 32 fixedly connected to the side of the door 20 by a weight W of the door 20 increases a friction force at a cross section contacting the vertical hooking tool 34, and thus friction noise is excessively generated when the door is rotated to be opened and closed. There is a problem in that it is difficult to avoid friction noise generated at the large-sized door with only the above-mentioned material solution.

Of course, the friction force at the cross section contacting the vertical hooking tool 34 may be reduced by lifting the door 20 fixed to the second support bracket 32 using various types of well-known lifting devices that use a hydraulic device or the like, and thus applying an upward displacement to the second support bracket. However, it is almost impossible to precisely adjust a height in a range of 0.1 mm to 0.5 mm using such lifting devices, and excessive expense is entailed in making it possible.

Until now, the problems in the related art related to a door hinge of a rotary door have been described focusing on the example in which the gear hinge part is used. As long as a structure in which a vertical displacement or distance may occur between components forming a door hinge part of a rotary door is provided, substantially the same technical problems as those in the gear hinge part will be generated even when a detailed configuration of the hinge part is changed.

DISCLOSURE

Technical Problem

The present invention is directed to providing a simple device which is capable of appropriately controlling a vertical displacement or distance generated between components forming a door hinge part even when the vertical displacement or distance is generated by a weight of a door forming a rotary door.

In particular, the present invention is directed to providing a device which is capable of precisely introducing a vertical upward displacement to a second support bracket in stages to reduce a degree of friction when a downward displacement is generated at a side of the second support bracket that is fixedly connected to a side of a door to form a gear hinge part of a rotary door and a friction noise at a cross section contacting a vertical hooking tool is increased.

Technical Solution

One aspect of the present invention provides a door hinge height adjusting device for rotating a door, which is provided at a door hinge, which rotatably connects one side surface of a door that forms a rotary door to a support frame of a door frame, and comprises a first support bracket fixedly connected to a side of the support frame of the door frame; a second support bracket fixedly connected to a side of the door; and a hinge part provided to be relatively rotated between the first support bracket and the second support bracket to adjust a relative vertical position of the second support bracket with respect to the first support bracket, the door hinge height adjusting device for rotating a door including a sliding block installed at a lower surface of the door; a first support plate and a second support plate configured to respectively support the second support bracket, which is rotated relative to the first support bracket that forms the door hinge, and the sliding block, which is located within a rotation range divided on a plane along a rotating track of the door fixedly connected to the second support bracket, from a lower side thereof; a door support block body which the first support plate and the second support plate are put on and fixed to to be disposed adjacent to each other on a plane and which is fixedly installed at a floor surface on which the door is installed or the support frame of the door frame; and a plurality of height adjusting thin plates stacked and disposed between the door support block body and each of the first support plate and the second support plate, wherein the sliding block that is located at the rotation range divided on the plane along the rotating track of the door is formed so that a height thereof supported by the first support plate and the second support plate, which are located at different, heights is changed in stages by adjusting the number of first height adjusting thin plates stacked and disposed between the first support plate and the door support block body and the number of second height adjusting thin plates stacked and disposed between the second support plate and the door support block body.

Here, each of the height adjusting thin plates may be formed by working a metal thin plate material including a stainless steel plate into a thin plate having a thickness of 0.1 mm to 0.2 mm. Therefore, an entire height range of about 0.1 mm to 1 mm may be finely divided and adjusted in small height adjusting stages of 0.1 mm to 0.2 mm.

Further, a rounded portion is provided at an upper corner of a boundary portion between the first support plate and the second support plate or at a corner of a lower surface of the sliding block to allow a smooth sliding movement of the sliding block that passes through a boundary portion that has a height difference between the first support plate and the second support plate.

Advantageous Effects

A door hinge height adjusting device for rotating a door according to the present invention can have the following effects.

According to a basic configuration of the present invention, even when a vertical displacement or distance between a first support bracket and a second support bracket of components of a door hinge part is generated by a weight of a door forming a rotary door, it is possible to appropriately and precisely control the vertical displacement or distance through a simple device, and thus it is possible to minimize friction with the second support bracket rotated relative to the first support bracket and other components forming a hinge part.

In particular, in a case in which a gear hinge part, a friction noise generated at a vertical hooking tool can be minimized by precisely controlling a relative height between the door and the second support bracket, and thus a noise generation problem due to an increase in a size of the door can be relieved.

DESCRIPTION OF DRAWINGS

FIG. 1 is a perspective view illustrating an installation state of a rotary door wherein an upper end corner portion is enlarged.

FIG. 2 is a perspective view illustrating the installation state of the rotary door wherein a lower end corner portion is enlarged.

FIG. 3 is an exploded perspective view illustrating a gear hinge part forming a door hinge of the rotary door of FIGS. 1 and 2.

FIGS. 4 to 7 are cross-sectional views illustrating an operation state of the gear hinge part of FIG. 3, wherein FIG. 4 illustrates a state in which a second support bracket connected to the door is folded and FIG. 7 illustrates a state in which the second support bracket is rotated so that the door is completely opened.

FIG. 8 is a view illustrating a change in an engaged state of a gear part according to a change in a rotation angle between a first support bracket and the second support bracket of the gear hinge part.

FIG. 9 is a view illustrating a state in which a vertical (longitudinal) relative displacement is generated between the first support bracket and the second support bracket of the gear hinge part.

FIG. 10 is an exploded perspective view of a rear of the gear hinge part, and FIG. 11 is an assembly view illustrating an assembled state of a vertical hooking tool in a main portion K of FIG. 10 when seen from a front side.

FIG. 12 is a view illustrating a state in which the engaged state of the gear part is changed according to the change in the rotation angle between the first support bracket and the second support bracket in the gear hinge part of FIG. 10.

FIG. 13 is a view illustrating a state in which a door hinge height adjusting device for rotating a door according to the present invention is installed at a rotary door.

FIG. 14 is a view illustrating one preferred embodiment of the door hinge height adjusting device for rotating a door according to the present invention.

FIG. 15 is a partially exploded perspective view of one embodiment of the door hinge height adjusting device for rotating a door of FIG. 14.

FIG. 16 is a view illustrating a state in which the number of height adjusting thin plates in FIG. 15 is increased by one.

FIGS. 17 and 18 are a plan view illustrating an installation state of the rotary door and a cross-sectional view illustrating an opening operation state of the door.

FIG. 19 is a cross-sectional view illustrating an operation state of a rotary door at which the door hinge height adjusting device for rotating a door according to one preferred embodiment of the present invention is installed.

FIG. 20 is an enlarged view of a portion A illustrating a main portion of FIG. 19.

FIGS. 21 to 28 are views illustrating a state in which a height of a door forming a rotary door is adjusted using the door hinge height adjusting device for rotating a door according to one preferred embodiment of the present invention.

MODES OF THE INVENTION

Hereinafter, exemplary embodiments of the present invention will be described in detail below with reference to the accompanying drawings to be easily implemented by those skilled in the art. However, the present invention may be embodied in different forms and is not to be construed as limited to the embodiments set forth herein.

FIG. 13 is a view illustrating a state in which a door hinge height adjusting device for rotating a door according to the present invention is installed at a rotary door, FIG. 14 is a view illustrating one preferred embodiment of the door hinge height adjusting device for rotating a door according to the present invention, FIG. 15 is a partially exploded perspective view of one embodiment of the door hinge height adjusting device for rotating a door of FIG. 14, and FIG. 16 is a view illustrating a state in which the number of height adjusting thin plates in FIG. 15 is increased by one.

First, one preferred embodiment of the door hinge height adjusting device for rotating a door according to the present invention will be described with reference to the drawings.

As illustrated in FIGS. 13 to 16, in one preferred embodiment of the present invention, a door hinge height adjusting device 300 is provided at a door hinge 30, which rotatably connects one side surface of a door 20 that forms a rotary door, to a support frame 10 of a door frame and comprises a first support bracket 31 that is fixedly connected to a side of the support frame 10 of the door frame, a second support bracket 32 fixedly connected to a side of the door 20, and a hinge part provided to be relatively rotated between the first support bracket 31 and the second support bracket 32 to adjust a relative vertical position of the second support bracket 32 with respect to the first support bracket 31.

The door hinge height adjusting device 300 includes a sliding block 380 attached to and installed at a lower surface of the door 20, as illustrated in FIG. 13; a first support plate 321 and a second support plate 322 which relatively support the second support bracket 32, which is relatively rotated with respect to the first support bracket 31 that forms the door hinge 30, and the sliding block 380, which is located within a rotation range divided on a plane along a rotating track of the door 20 that is fixedly connected to the second support bracket 32, from a lower side thereof; a door support block body 310 which the first support plate 321 and the second support plate 322 are put on and are fixed thereto to be disposed adjacent to each other on a plane and which is fixedly installed at a floor surface on which the door 20 is installed or the support frame 10 of the door frame; and a plurality of height adjusting thin plates 330 stacked and disposed between the door support block body 310 and each of the first support plate 321 and the second support plate 322, as illustrated in FIGS. 14 and 15.

Here, the door support block body 310 may be formed to have the first support plate 321 and the second support plate 322 on two divided planes to divide a corner at 45°, as illustrated in the drawing.

As illustrated in FIG. 16 when compared with FIG. 15, the number (one in FIG. 15: two in FIG. 16) of the first height adjusting thin plates 330 stacked and disposed between the first support plate 321 and the door support block body 310 and the number of the second height adjusting thin plates 330 stacked and disposed between the second support plate 322 and the door support block body 310 may be adjusted, and thus the sliding block 380, which is located at the rotation range divided on a plane along the rotating track of the door 20, may be formed so that a height thereof supported by the first support plate 321 and the second support plate 322, which are located at different heights, is changed in stages. Here, a detailed operation process in which the supported height of the sliding block 380 is changed in stages by the door hinge height adjusting device 300 will be described below with reference to FIGS. 19, 20, and 21 to 28.

According to the preferred embodiment of the present invention, it is preferable in terms of accurate and precise height adjustment that the height adjusting thin plate 330 is formed of a stainless steel plate having a thickness of 0.1 mm to 0.2 mm, and it is more preferable that a rounded portion is provided at upper corners 321*a* and 322*a* of a boundary portion between the first support plate 321 and the second support plate 322 to allow the sliding block 380 to be smoothly slid when the sliding block 380 passes through a boundary portion that has a height difference between the first support plate 321 and the second support plate 322.

Of course, the rounded portion may be provided at a corner of a lower surface of the sliding block 380 to allow the sliding block 380 to be smoothly slid when the sliding block 380 passes through the boundary portion having the height difference between the first support plate 321 and the second support plate 322.

A simple inclined surface may be provided instead of the above-mentioned rounded portion. However, in an aspect of the present invention, the inclined surface may be interpreted as equivalent to the rounded portion.

Meanwhile, fixing holes 321*b* and 322*b* are formed at the first support plate 321 and the second support plate 322, through-holes 330*b* are formed at corresponding positions of a plurality of height adjusting thin plates 330, and fastening screws 341 and 342 pass through the fixing holes 321*b* and 322*b* and the through-holes 330*b* and are fastened and fixed to upper fastening holes 310*b* of the door support block body 310 in order for the first support plate 321 and the second support plate 322 to be fixed to an upper surface of the door support block body 310.

Screw heads of the fastening screws 341 and 342 should be formed to be located under upper planes of the first support plate 321 and the second support plate 322 when the fastening screws 341 and 342 are fastened and fixed to the upper fastening holes 310*b* of the door support block body 310.

To secure a fixing position of the door support block body 310, it is preferable for a fixing flange 311 fixedly installed at a lower end frame 10*d* that forms the support frame 10 of the door frame to be provided at one side of the door support block body 310, and a fastening screw 315 fastened through a fastening hole 311*a* formed at the fixing flange 311 is fixed to an upper surface of the lower end frame 10*d* forming the support frame 10 of the door frame.

On the other hand, another fastening hole 314 may be transversely provided at a center portion of the door support block body 310, and a fastening screw 316 (refer to FIG. 22) that passes through the fastening hole 314 may be fixed to a side surface of the lower end frame 10*d* forming the support frame 10 of the door frame, and thus the fixing position can be more certainly secured.

Furthermore, according to a more preferable embodiment of the present invention, an additional block 312 for adjusting an installation height, which corrects a relative height difference between a floor surface on which a door is installed and the lower end frame 10*d*, may be provided at a lower surface of the door support block body 310. The lower surface of the door support block body 310 may be welded and fixed to an anchor 318 (refer to FIG. 22) which is buried in and installed at a framework of the floor surface on which the door is installed to prevent deflection of the door support block body 310 due to a weight of the door.

Hereinafter, a configuration of a rotary door using the door hinge height adjusting device 300 described with reference to FIGS. 13 to 16 will be described with reference to FIGS. 17 and 18.

FIG. 17 illustrates an example of a rotary door. The rotary door is provided with the door 20, which has a door handle 20*h*, forming the rotary door and a door hinge 30 of which one side surface is rotatably connected to the support frame 10 of a door frame. The door hinge 30 includes the first support bracket 31 fixedly connected to the side of the support frame 10 of the door frame; a second support bracket 32 fixedly connected to the side of the door 20; and a hinge part provided to be relatively rotated between the first support bracket 31 and the second support bracket 32. Here, a portion of FIG. 17 designated by reference numeral 33 is the hinge part which is provided to be relatively rotated between the first support bracket 31 and the second support bracket 32, and when the rotary door to which the present invention is applied has the gear hinge part illustrated in FIGS. 1 to 12 as the door hinge 30, reference numeral 33 may include the rotation support frame 33 configuration of the gear parts 31*a* and 32*a* which are supported to the rotation support frame 33, and the like.

More specifically, when the hinge part is provided as the gear hinge part, surfaces of the first support bracket 31 and the second support bracket 32 that face each other include the gear parts 31*a* and 32*a* which are longitudinally formed to be engaged with each other; the rotation support frame 33 which supports the gear parts 31*a* and 32*a* at the rear side thereof between the first support bracket 31 and the second support bracket 32 so that the first support bracket 31 and the second support bracket 32 are hinge-rotated while the gear parts 31*a* and 32*a* of the first support bracket 31 and the second support bracket 32 are maintained in the engaged state with each other and the gear tooth portions thereof that are engaged with each other are changed; and the rotating shaft support pockets 31*b* and 32*b* which are formed at a side of the first support bracket 31 and the second support bracket 32 that is opposite to the gear parts 31*a* and 32*a* so that the hinge shaft protruding portions 33*a* formed to be bent from both of the ends of the rotation support frame 33 are rotatably inserted therein.

The first support bracket 31 and the second support bracket 32 are provided to be interlocked with each other and to be shaft-rotated about the hinge shaft protruding portions 33*a* formed at both of the ends of the rotation support frame 33 accommodated in the rotating shaft support pockets 31*b* and 32*b*, and when outer corners of the bent portions formed at both of the ends of the rotation support frame 33 are accommodated in the rotating shaft support pockets 31*b* and 32*b* which are formed at outer side surfaces of the first support bracket 31 and the second support bracket 32, a rotation thereof is no longer allowed.

In the below drawings, a portion designated by reference numeral 33 may be understood as including an equivalent of the above-described gear hinge part although the detailed configuration of the hinge part is changed as long as the structure in which a vertical displacement or distance may occur between components forming the door hinge part is provided.

FIG. 18 illustrates an operation state in which the door 20 is opened and closed by a rotating action of the second support bracket 32 with respect to the first support bracket 31 occurring in the door hinge part 30. In a state B in which the door 20 is partially opened unlike a state A in which the door 20 is closed, the lower end frame 10*d* of the support frame 10 of the door frame is also illustrated.

When the door hinge height adjusting device 300 according to the preferred embodiment of the present invention is installed at the rotary door having the above-described configuration, the sliding block 380 attached to and installed at a lower surface of the door 20 is slid at the lower end of the door 20 which is rotated along with the second support bracket 32 that is rotated relative to the first support bracket 31 forming the door hinge 30 while being supported between the first support plate 321 and the second support plate 322 divided on a plane along the rotating track of the door 20, as illustrated in FIGS. 19 and 20.

In FIG. 20, a position of the sliding block 380 that is indicated by a dotted line shows a state (the state A of FIG. 18) in which the door 20 is closed, a position of the sliding block 380 that is indicated by an alternate long and short dash line shows a state (the state B of FIG. 18) in which the door 20 is opened by about 90°, and a position of the sliding block 380 that is indicated by a solid line shows a state in which the door 20 is completely opened by about 180°. In this regard, it may be understood that the sliding block 380 is put on an upper surface of the second support plate 322 while the door 20 is completely opened by about 180°, the sliding block 380 is put on an upper surface of the first support plate 321 while the door 20 is closed, and the sliding block 380 is located at a boundary portion between the first support plate 321 and the second support plate 322 while the door 20 is opened by about 90°.

In this situation, if there is a difference in the number of the height adjusting thin plates 330 stacked and disposed between each of the first support plate 321 and the second support plate 322 and the door support block body 310 for supporting all of the first support plate 321 and the second support plate 322, a height of each of the first support plate 321 and the second support plate 322 located thereon is changed, and thus a height of a surface which supports the sliding block 380 that slides along the upper surface is also changed by a thickness of the height adjusting thin film 330, and the door 20 may generate a vertical shift displacement between the components forming the door hinge while performing a rotating action about the door hinge 30, and a fine clearance adjustment may be allowed therethrough.

FIGS. 19 and 20 are plan views, and since it is difficult to check a detailed height adjusting operation state through the drawings, cross-sectional views taken along line a-a of FIG. 20 illustrating the operation state are illustrated in FIGS. 21 to 28.

FIG. 21 illustrates a closed state of the door 20 indicated by the dotted line in FIG. 20 and FIG. 22 is an enlarged view of a portion B1 of FIG. 2.1.

According to FIGS. 21 and 22, the height adjusting thin plate 330 below the first support plate 321 includes two higher adjusting thin plates, which are designated by reference numerals 330-1 and 330-2 in FIG. 22, and the second height adjusting thin plate 330 under the second support plate 322 includes three higher adjusting thin plates, which are designated by reference numerals 330-1, 330-2 and 330-3 in FIG. 22. Therefore, a height of the second support plate 322 is higher than that of the first support plate 321 by a thickness of the height adjusting thin plate that is designated by reference numeral 330-3, and a position of the sliding block 380 in this state is located on the first support plate 321. This state may be achieved by loosening and separating the fastening screw 342 for fixing the second support plate 322 to the door support block body 310 in the closed state of the door 20 and then increasing the number of second height adjusting thin plates 330 disposed between the second support plate 322 and the door support block body 310 by one (one is an example in the drawing, but the present invention is not limited thereto).

In this situation, when the door 20 is rotated and opened by 180° through the door hinge part 33, the state illustrated in FIGS. 23 and 24 (a partially enlarged view of a portion B2 of FIG. 23) is achieved, and this state is a position corresponding to that of the sliding block 380 indicated by the solid line in FIG. 20.

According to FIG. 23 and FIG. 24 which correspond to the partially enlarged view of the portion B2 of FIG. 23, the sliding block 380 is located on the second support plate 322, which is higher than that of the first support plate 321, on which the sliding block 380 was previously located, by the thickness of the height adjusting thin plate that is designated by reference numeral 330-3, and thus a vertical height of the door 20 and a relative vertical height of the second support bracket 32 forming the rotary hinge part 30 with respect to the first support bracket 31 are also increased by the thickness (e.g., 0.1 mm) of the height adjusting thin plate that is designated by reference numeral 330-3.

In this state, the fastening screw 341 which fixes the first support plate 321 to the door support block body 310 may be loosened and separated, and then the number of height adjusting thin plates 330 disposed between the first support plate 321 and the door support block body 310 may be increased by one (one is an example in the drawing, but the present invention is not limited thereto) to have the same height as that of the second support plate 322, thereby recovering a normal door installation state, as illustrated in FIG. 25 and FIG. 26 which correspond to a partially enlarged view of a portion B3 of FIG. 25. In this state, when the door 20 is closed, the sliding block 380 is slid along a horizontal plane formed by the second support plate 322 and the first support plate 321, as illustrated in FIG. 27 and FIG. 28 which correspond to a partially enlarged view of a portion B4 of FIG. 27.

FIGS. 21 to 28 illustrate a one-step height adjusting process, and a height may be finely adjusted by repeatedly performing the height adjusting process through multiple stages.

Meanwhile, the height of the first support plate 321 may be increased to be higher than that of the second support plate 322 by increasing the number of second height adjusting thin plates 330 disposed between the first support plate 321 and the door support block body 310 by two without switching into a plane state, which is illustrated in FIGS. 25 and 26 from the state illustrated in FIGS. 23 and 24. In this case, an upward movement action of the sliding block 380 is generated even when the door 20 is closed again.

In the door hinge height adjusting device 300 for rotating a door according to the present invention, the sliding block 380 located at the rotation range divided on a plane along the rotating track of the door 20 is allowed to change a height thereof supported by the first support plate 321 and the second support plate 322, which are located at different heights, in stages by adjusting the number of first height adjusting thin plates 330 stacked and disposed between the first support plate 321 and the door support block body 310 and the number of second height adjusting thin plates 330 stacked and disposed between the second support plate 322 and the door support block body 310 through the above-described operation process, and thus a required relative vertical displacement between the components forming the door hinge part may be induced.

Meanwhile, the sliding block 380 attached to and installed at a lower portion of the door 20 may be formed as a separate component as illustrated in the drawing, may be attached to and installed at the lower surface thereof, and may also be integrally formed with the lower surface of the door 20. It should be appreciated by those skilled in the art that the present invention may also include such a structure.

Although a few embodiments of the present invention have been shown and described, it should be appreciated by those skilled in the art that changes may be made in these embodiments without departing from the principles and spirit of the invention, the scope of which is defined in the claims and their equivalents.

The invention claimed is:

1. A door hinge height adjusting device (300) for rotating a door, which is provided at a door hinge (30), which rotatably connects one side surface of a door (20) that forms a rotary door to a support frame (10) of a door frame, and comprises a first support bracket (31) fixedly connected to a side of the support frame (10) of the door frame; a second support bracket (32) fixedly connected to a side of the door (20); and a hinge part provided to be relatively rotated between the first support bracket (31) and the second support bracket (32) to adjust a relative vertical position of the second support bracket (32) with respect to the first support bracket (31), the door hinge height adjusting device comprising:

a sliding block (380) installed at a lower surface of the door (20);

a first support plate (321) and a second support plate (322) configured to respectively support the second support bracket (32), which is rotated relative to the first support bracket (31) that forms the door hinge (30), and the sliding block (380), which is located within a rotation range divided on a plane along a rotating track of the door (20) fixedly connected to the second support bracket (32), from a lower side thereof;

a door support block body (310) which the first support plate (321) and the second support plate (322) are put on and fixed to be disposed adjacent to each other on a plane and which is fixedly installed at a floor surface on which the door (20) is installed or the support frame (10) of the door frame; and a plurality of height adjusting thin plates (330) stacked and disposed between the door support block body (310) and each of the first support plate (321) and the second support plate (322), wherein the sliding block (380) that is located at the rotation range divided on the plane along the rotating track of the door (20) is formed so that a height thereof supported by the first support plate (321) and the second support plate (322), which are located at different heights, is changed in stages by adjusting the number of first height adjusting thin plates (330) stacked and disposed between the first support plate (321) and the door support block body (310) and the number of second height adjusting thin plates (330) stacked and disposed between the second support plate (322) and the door support block body (310).

2. The door hinge height adjusting device of claim 1, wherein each of the height adjusting thin plates (330) is formed of a metal thin plate including a stainless steel plate and having a thickness of 0.1 mm to 0.2 mm.

3. The door hinge height adjusting device of claim 1, wherein a rounded portion is provided at upper corners (321*a* and 322*a*) of a boundary portion between the first support plate (321) and the second support plate (322) to allow a smooth sliding movement of the sliding block (380) that pass through a boundary portion that has a height difference between the first support plate (321) and the second support plate (322).

4. The door hinge height adjusting device of claim 1, wherein a rounded portion is provided at a corner of a lower surface of the sliding block (380) to allow a smooth sliding movement of the sliding block (380) that pass through a boundary portion that has a height difference between the first support plate (321) and the second support plate (322).

5. The door hinge height adjusting device of claim 1, wherein, fixing holes (321*b* and 322*b*) are formed at the first support plate (321) and the second support plate (322), through-holes (330*b*) are formed at corresponding positions of the plurality of height adjusting thin plates (330), and fastening screws (341 and 342) pass through the fixing holes (321*b* and 322*b*) and the through-holes (330*b*) and are fastened and fixed to upper fastening holes (310*b*) of the door support block body (310) in order for the first support plate (321) and the second support plate (322) to be fixed to an upper surface of the door support block body (310), and screw heads of the fastening screws (341 and 342) are formed to be located under upper planes of the first support plate (321) and the second support plate (322) when the fastening screws (341 and 342) are fastened and fixed to the upper fastening holes (310*b*) of the door support block body (310).

6. The door hinge height adjusting device of claim 1, wherein a fixing flange (311) fixedly installed at a lower end frame (10*d*) which forms the support frame (10) of the door frame is provided at one side of the door support block body (310).

7. The door hinge height adjusting device of claim 6, wherein an additional block (312) for adjusting an installation height, which corrects a relative height difference between the floor surface on which the door is installed and the lower end frame (10*d*), is provided at a lower surface of the door support block body (310).

8. The door hinge height adjusting device of claim 6, wherein a lower surface of the door support block body (310) is welded and fixed to an anchor (318) which is buried in and installed at a framework of the floor surface on which the door is installed.

9. The door hinge height adjusting device of claim 1, wherein the hinge part provided to be relatively rotated between the first support bracket (31) and the second support bracket (32) of the door hinge (30) is provided as a gear hinge part, and surfaces of the first support bracket (31) and the second support bracket (32) that face each other include gear parts (31*a* and 32*a*) which are longitudinally formed to be engaged with each other; a rotation support frame (33) which supports the gear parts (31*a* and 32*a*) at a rear side thereof between the first support bracket (31) and the second support bracket (32) so that the first support bracket (31) and the second support bracket (32) are hinge-rotated while the gear parts (31*a* and 32*a*) of the first support bracket (31) and the second support bracket (32) are maintained in an engaged state with each other and gear tooth portions thereof that are engaged with each other are changed; and rotating shaft support pockets (31*b* and 32*b*) which are formed at a side of the first support bracket (31) and the second support bracket (32) opposite to the gear parts (31*a* and 32*a*) so that hinge shaft protruding portions (33*a*) that are formed to be bent from both ends of the rotation support frame (33) are rotatably inserted therein, and the first support bracket (31) and the second support bracket (32) are provided to be interlocked with each other and to be shaft-rotated about the hinge shaft protruding portions (33*a*) that are formed at both of the ends of the rotation support frame 33 which are accommodated in the rotating shaft support pockets (31*b* and 32*b*), and when outer corners of the bent portions formed at both of the ends of the rotation support frame (33) are accommodated in the rotating shaft support pockets (31*b* and 32*b*) which are formed at outer side surfaces of the first support bracket 31 and the second support bracket 32, a rotation thereof is prevented.

10. The door hinge height adjusting device of claim 2, wherein the hinge part provided to be relatively rotated between the first support bracket (31) and the second support bracket (32) of the door hinge (30) is provided as a gear hinge part, and surfaces of the first support bracket (31) and the second support bracket (32) that face each other include gear parts (31*a* and 32*a*) which are longitudinally formed to be engaged with each other; a rotation support frame (33) which supports the gear parts (31*a* and 32*a*) at a rear side thereof between the first support bracket (31) and the second support bracket (32) so that the first support bracket (31) and the second support bracket (32) are hinge-rotated while the gear parts (31*a* and 32*a*) of the first support bracket (31) and the second support bracket (32) are maintained in an engaged state with each other and gear tooth portions thereof that are engaged with each other are changed; and rotating shaft support pockets (31*b* and 32*b*) which are formed at a side of the first support bracket (31) and the second support bracket (32) opposite to the gear parts (31*a* and 32*a*) so that hinge shaft protruding portions (33*a*) that are formed to be bent from both ends of the rotation support frame (33) are rotatably inserted therein, and the first support bracket (31) and the second support bracket (32) are provided to be interlocked with each other and to be shaft-rotated about the hinge shaft protruding portions (33*a*) that are formed at both of the ends of the rotation support frame 33 which are accommodated in the rotating shaft support pockets (31*b* and 32*b*), and when outer corners of the bent portions formed at both of the ends of the rotation support frame (33) are accommodated in the rotating shaft support pockets (31*b* and 32*b*) which are formed at outer side surfaces of the first support bracket 31 and the second support bracket 32, a rotation thereof is prevented.

11. The door hinge height adjusting device of claim 3, wherein the hinge part provided to be relatively rotated between the first support bracket (31) and the second support bracket (32) of the door hinge (30) is provided as a gear hinge part, and surfaces of the first support bracket (31) and the second support bracket (32) that face each other include gear parts (31*a* and 32*a*) which are longitudinally formed to be engaged with each other; a rotation support frame (33) which supports the gear parts (31*a* and 32*a*) at a rear side thereof between the first support bracket (31) and the second support bracket (32) so that the first support bracket (31) and the second support bracket (32) are hinge-rotated while the gear parts (31*a* and 32*a*) of the first support bracket (31) and the second support bracket (32) are maintained in an engaged state with each other and gear tooth portions thereof that are engaged with each other are changed; and rotating shaft support pockets (31*b* and 32*b*) which are formed at a side of the first support bracket (31) and the second support bracket (32) opposite to the gear parts (31*a* and 32*a*) so that hinge shaft protruding portions (33*a*) that are formed to be bent from both ends of the rotation support frame (33) are rotatably inserted therein, and the first support bracket (31) and the second support bracket (32) are provided to be interlocked with each other and to be shaft-rotated about the hinge shaft protruding portions (33*a*) that are formed at both of the ends of the rotation support frame 33 which are accommodated in the rotating shaft support pockets (31*b* and 32*b*), and when outer corners of the bent portions formed at both of the ends of the rotation support frame (33) are accommodated in the rotating shaft support pockets (31*b* and 32*b*) which are formed at outer side surfaces of the first support bracket 31 and the second support bracket 32, a rotation thereof is prevented.

12. The door hinge height adjusting device of claim 4, wherein the hinge part provided to be relatively rotated between the first support bracket (31) and the second support bracket (32) of the door hinge (30) is provided as a gear hinge part, and surfaces of the first support bracket (31) and the second support bracket (32) that face each other include gear parts (31*a* and 32*a*) which are longitudinally formed to be engaged with each other; a rotation support frame (33) which supports the gear parts (31*a* and 32*a*) at a rear side thereof between the first support bracket (31) and the second support bracket (32) so that the first support bracket (31) and the second support bracket (32) are hinge-rotated while the gear parts (31*a* and 32*a*) of the first support bracket (31) and the second support bracket (32) are maintained in an engaged state with each other and gear tooth portions thereof that are engaged with each other are changed; and rotating shaft support pockets (31*b* and 32*b*) which are formed at a side of the first support bracket (31) and the second support bracket (32) opposite to the gear parts (31*a* and 32*a*) so that hinge shaft protruding portions (33*a*) that are formed to be bent from both ends of the rotation support frame (33) are rotatably inserted therein, and the first support bracket (31) and the second support bracket (32) are provided to be interlocked with each other and to be shaft-rotated about the hinge shaft protruding portions (33*a*) that are formed at both of the ends of the rotation support frame 33 which are accommodated in the rotating shaft support pockets (31*b* and 32*b*), and when outer corners of the bent portions formed at both of the ends of the rotation support frame (33) are accommodated in the rotating shaft support pockets (31*b* and 32*b*) which are formed at outer side surfaces of the first support bracket 31 and the second support bracket 32, a rotation thereof is prevented.

13. The door hinge height adjusting device of claim 5, wherein the hinge part provided to be relatively rotated between the first support bracket (31) and the second support bracket (32) of the door hinge (30) is provided as a gear hinge part, and surfaces of the first support bracket (31) and the second support bracket (32) that face each other include gear parts (31*a* and 32*a*) which are longitudinally formed to be engaged with each other; a rotation support frame (33) which supports the gear parts (31*a* and 32*a*) at a rear side thereof between the first support bracket (31) and the second support bracket (32) so that the first support bracket (31) and the second support bracket (32) are hinge-rotated while the gear parts (31*a* and 32*a*) of the first support bracket (31) and the second support bracket (32) are maintained in an engaged state with each other and gear tooth portions thereof that are engaged with each other are changed; and rotating shaft support pockets (31*b* and 32*b*) which are formed at a side of the first support bracket (31) and the second support bracket (32) opposite to the gear parts (31*a* and 32*a*) so that hinge shaft protruding portions (33*a*) that are formed to be bent from both ends of the rotation support frame (33) are rotatably inserted therein, and the first support bracket (31) and the second support bracket (32) are provided to be interlocked with each other and to be shaft-rotated about the hinge shaft protruding portions (33*a*) that are formed at both of the ends of the rotation support frame 33 which are accommodated in the rotating shaft support pockets (31*b* and 32*b*), and when outer corners of the bent portions formed at both of the ends of the rotation support frame (33) are accommodated in the rotating shaft support pockets (31*b* and 32*b*) which are formed at outer side surfaces of the first support bracket 31 and the second support bracket 32, a rotation thereof is prevented.

14. The door hinge height adjusting device of claim 6, wherein the hinge part provided to be relatively rotated between the first support bracket (31) and the second support bracket (32) of the door hinge (30) is provided as a gear hinge part, and surfaces of the first support bracket (31) and the second support bracket (32) that face each other include gear parts (31*a* and 32*a*) which are longitudinally formed to be engaged with each other; a rotation support frame (33) which supports the gear parts (31*a* and 32*a*) at a rear side thereof between the first support bracket (31) and the second support bracket (32) so that the first support bracket (31) and the second support bracket (32) are hinge-rotated while the gear parts (31*a* and 32*a*) of the first support bracket (31) and the second support bracket (32) are maintained in an engaged state with each other and gear tooth portions thereof that are engaged with each other are changed; and rotating shaft support pockets (31*b* and 32*b*) which are formed at a side of the first support bracket (31) and the second support bracket (32) opposite to the gear parts (31*a* and 32*a*) so that hinge shaft protruding portions (33*a*) that are formed to be bent from both ends of the rotation support frame (33) are rotatably inserted therein, and the first support bracket (31) and the second support bracket (32) are provided to be interlocked with each other and to be shaft-rotated about the hinge shaft protruding portions (33*a*) that are formed at both of the ends of the rotation support frame 33 which are accommodated in the rotating shaft support pockets (31*b* and 32*b*), and when outer corners of the bent portions formed at both of the ends of the rotation support frame (33) are accommodated in the rotating shaft support pockets (31*b* and 32*b*) which are formed at outer side surfaces of the first support bracket 31 and the second support bracket 32, a rotation thereof is prevented.

15. The door hinge height adjusting device of claim 7, wherein the hinge part provided to be relatively rotated between the first support bracket (31) and the second support bracket (32) of the door hinge (30) is provided as a gear hinge part, and surfaces of the first support bracket (31) and the second support bracket (32) that face each other include gear parts (31*a* and 32*a*) which are longitudinally formed to be engaged with each other; a rotation support frame (33) which supports the gear parts (31*a* and 32*a*) at a rear side thereof between the first support bracket (31) and the second support bracket (32) so that the first support bracket (31) and the second support bracket (32) are hinge-rotated while the gear parts (31*a* and 32*a*) of the first support bracket (31) and the second support bracket (32) are maintained in an engaged state with each other and gear tooth portions thereof that are engaged with each other are changed; and rotating shaft support pockets (31*b* and 32*b*) which are formed at a side of the first support bracket (31) and the second support bracket (32) opposite to the gear parts (31*a* and 32*a*) so that hinge shaft protruding portions (33*a*) that are formed to be bent from both ends of the rotation support frame (33) are rotatably inserted therein, and the first support bracket (31) and the second support bracket (32) are provided to be interlocked with each other and to be shaft-rotated about the hinge shaft protruding portions (33*a*) that are formed at both of the ends of the rotation support frame 33 which are accommodated in the rotating shaft support pockets (31*b* and 32*b*), and when outer corners of the bent portions formed at both of the ends of the rotation support frame (33) are accommodated in the rotating shaft support pockets (31*b* and 32*b*) which are formed at outer side surfaces of the first support bracket 31 and the second support bracket 32, a rotation thereof is prevented.

16. The door hinge height adjusting device of claim 8, wherein the hinge part provided to be relatively rotated between the first support bracket (31) and the second support bracket (32) of the door hinge (30) is provided as a gear hinge part, and surfaces of the first support bracket (31) and the second support bracket (32) that face each other include gear parts (31*a* and 32*a*) which are longitudinally formed to be engaged with each other; a rotation support frame (33) which supports the gear parts (31*a* and 32*a*) at a rear side thereof between the first support bracket (31)

and the second support bracket (32) so that the first support bracket (31) and the second support bracket (32) are hinge-rotated while the gear parts (31*a* and 32*a*) of the first support bracket (31) and the second support bracket (32) are maintained in an engaged state with each other and gear tooth portions thereof that are engaged with each other are changed; and rotating shaft support pockets (31*b* and 32*b*) which are formed at a side of the first support bracket (31) and the second support bracket (32) opposite to the gear parts (31*a* and 32*a*) so that hinge shaft protruding portions (33*a*) that are formed to be bent from both ends of the rotation support frame (33) are rotatably inserted therein, and the first support bracket (31) and the second support bracket (32) are provided to be interlocked with each other and to be shaft-rotated about the hinge shaft protruding portions (33*a*) that are formed at both of the ends of the rotation support frame 33 which are accommodated in the rotating shaft support pockets (31*b* and 32*b*), and when outer corners of the bent portions formed at both of the ends of the rotation support frame (33) are accommodated in the rotating shaft support pockets (31*b* and 32*b*) which are formed at outer side surfaces of the first support bracket 31 and the second support bracket 32, a rotation thereof is prevented.

* * * * *